US010865963B2

(12) United States Patent
Brown et al.

(10) Patent No.: US 10,865,963 B2
(45) Date of Patent: Dec. 15, 2020

(54) ARCHITECTURAL LINEAR LUMINAIRE

(71) Applicant: Nicor, Inc., Albuquerque, NM (US)

(72) Inventors: David Brown, Rio Rancho, NM (US); Trevor Shaw, Albuquerque, NM (US); Jorge Alfredo Gomez Martinez, Albuquerque, NM (US); Ye Jin, Albuquerque, NM (US); Jiabin Yu, Zhongshan (CN); Zihai Lu, Zhongshan (CN)

(73) Assignee: NICOR, INC., Albuquerque, NM (US)

( * ) Notice: Subject to any disclaimer, the term of this patent is extended or adjusted under 35 U.S.C. 154(b) by 0 days.

(21) Appl. No.: 16/653,926

(22) Filed: Oct. 15, 2019

(65) Prior Publication Data

US 2020/0049326 A1 Feb. 13, 2020

Related U.S. Application Data

(63) Continuation-in-part of application No. 15/974,534, filed on May 8, 2018, now Pat. No. 10,473,298, and (Continued)

(51) Int. Cl.

| | |
|---|---|
| ***F21V 5/00*** | (2018.01) |
| ***F21V 15/01*** | (2006.01) |
| ***F21V 15/015*** | (2006.01) |
| ***F21V 3/02*** | (2006.01) |
| ***F21V 23/06*** | (2006.01) |

(Continued)

(52) U.S. Cl.

CPC ..... *F21V 15/013* (2013.01); *F21V 3/02* (2013.01); *F21V 15/015* (2013.01); *F21V 23/002* (2013.01); *F21V 23/003* (2013.01); *F21V 23/0471* (2013.01); *F21V 23/06* (2013.01); *F21Y 2103/10* (2016.08); *F21Y 2115/10* (2016.08)

(58) Field of Classification Search

CPC ..... F21V 15/013; F21V 15/015; F21V 3/02; F21V 23/06; F21V 23/002; F21V 23/003; F21V 19/0045; F21Y 2115/10; F21Y 2103/10; F21S 2/00; H05B 47/185; H05B 47/18

USPC ..... 362/224

See application file for complete search history.

(56) References Cited

U.S. PATENT DOCUMENTS

| | | | | |
|---|---|---|---|---|
| 10,473,298 | B1 * | 11/2019 | Gomez Martinez | F21V 17/10 |
| 2012/0113628 | A1 * | 5/2012 | Burrow | F21V 29/74 362/184 |

(Continued)

*Primary Examiner* — Ali Alavi

(74) *Attorney, Agent, or Firm* — Loza & Loza LLP; Richard H. Krukar

(57) ABSTRACT

A luminaire for architectural, industrial and warehouse applications can be assembled using an extruded housing having curved sides connected by a cross member. Window openings in the curved sides can allow light to exit toward the sides of the luminaire while most of the light exits through a lens on the bottom. The extrusion can have channels and slots such that optical elements and an LED array can be slid into the housing and retained by endcaps. A housing cover can overlie a wireway while being held in place by screws creating a clamping force between the housing cover and fixture brackets retained within the housing. The luminaire can be suspended by the fixture brackets or by elements attached to the fixture brackets.

20 Claims, 19 Drawing Sheets

Related U.S. Application Data a continuation-in-part of application No. 16/169,856, filed on Oct. 24, 2018.

(60) Provisional application No. 62/576,877, filed on Oct. 25, 2017, provisional application No. 62/668,642, filed on May 8, 2018, provisional application No. 62/764,678, filed on Aug. 15, 2018.

(51) Int. Cl.

| | |
|---|---|
| ***F21V 23/00*** | (2015.01) |
| ***F21V 23/04*** | (2006.01) |
| *F21Y 115/10* | (2016.01) |
| *F21Y 103/10* | (2016.01) |

(56) References Cited

U.S. PATENT DOCUMENTS

| | | | | |
|---|---|---|---|---|
| 2012/0250309 | A1* | 10/2012 | Handsaker | F21V 5/007 362/235 |
| 2012/0320627 | A1* | 12/2012 | Araki | F21K 9/275 362/608 |

* cited by examiner

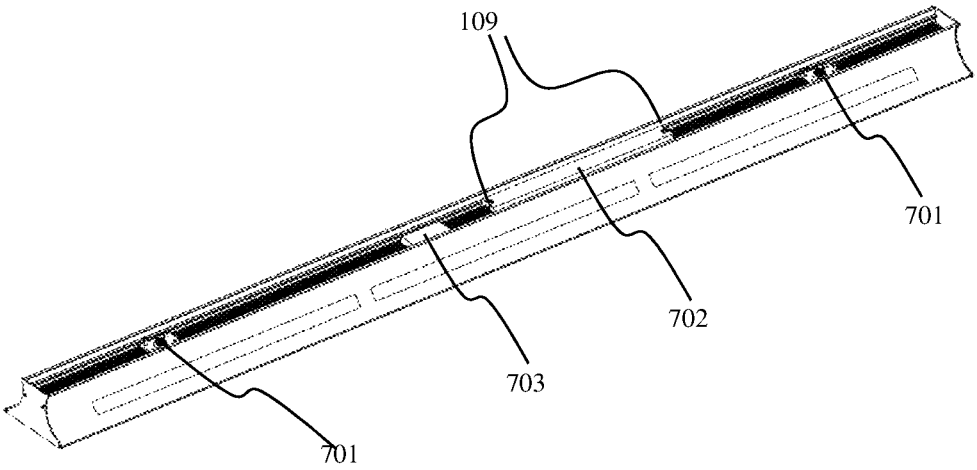
Fig. 7
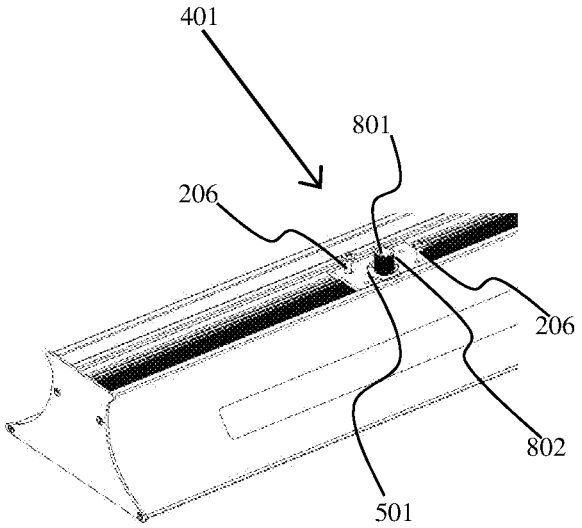
Fig. 8 - Bracket Assembly

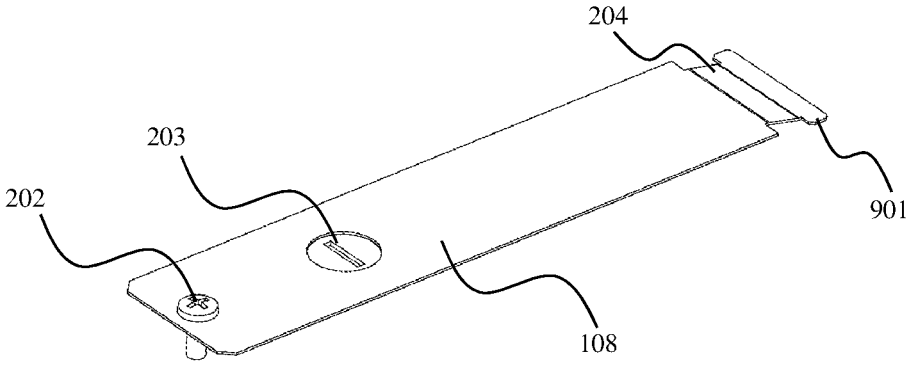
Fig. 9
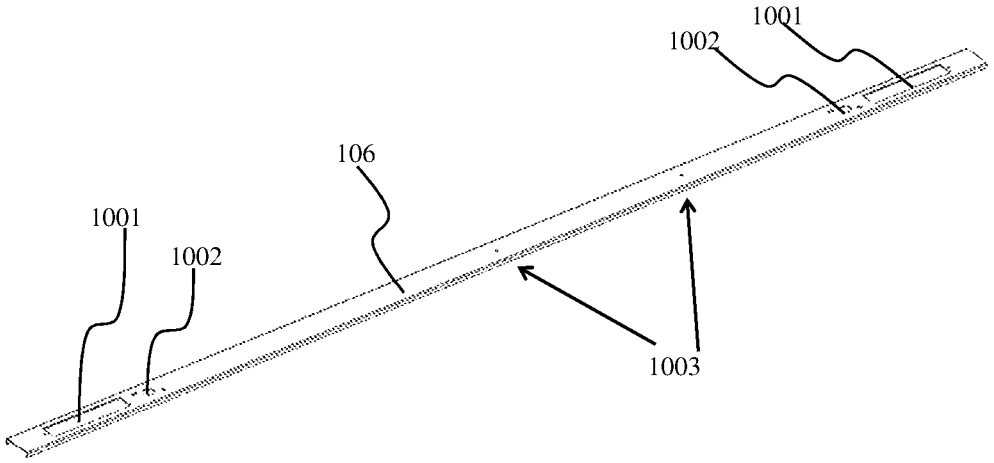
Fig. 10 - Power Supply Cover

ARCHITECTURAL LINEAR LUMINAIRE

CROSS REFERENCE TO RELATED PATENT APPLICATIONS

This patent application is a continuation in part of U.S. patent application Ser. Nos. 15/974,534 and 16/169,856 and claims the priority and benefit of U.S. Provisional Patent Applications 62/576,877, 62/668,642, and 62/764,678. U.S. patent application Ser. No. 15/974,534 is titled "Architectural Linear Luminaire" and was filed May 8, 2018. U.S. patent application Ser. No. 16/169,856 is titled "METHOD AND SYSTEM FOR POWER SUPPLY CONTROL" and was filed Oct. 24, 2018. U.S. Provisional Patent Application 62/576,877 is titled "LUMINAIRE POWER BANK" and was filed Oct. 25, 2017. U.S. Provisional Patent Application 62/668,642 is titled "METHOD AND SYSTEM FOR POWER SUPPLY CONTROL" and was filed May 8, 2018. U.S. Provisional Patent Application 62/764,678 is titled "METHOD AND SYSTEM FOR POWER SUPPLY CONTROL" and was filed Aug. 15, 2018. U.S. patent application Ser. Nos. 15/974,534 and 16/169,856 and U.S. Provisional Patent Applications 62/576,877, 62/668,642, and 62/764,678 are herein incorporated by reference in their entirety.

TECHNICAL FIELD

Embodiments are generally related to LED lighting, lighting fixtures, and LED lighting power supplies.

BACKGROUND

Lighting systems have been evolving at a rapid pace with moves from incandescent, fluorescent, and gas discharge to light emitting diodes (LEDs). LEDs have been improving in efficiency, thermal management, and cost. Similarly, the power supplies, a.k.a. drivers, which drive the LEDs have seen improvements in efficiency, thermal management and cost. In general, residential and commercial lighting is transitioning to the use of LED lighting technologies.

U.S. Pat. No. 7,311,423 by Frecska et al. issued on Dec. 25, 2007 and is titled "Adjustable LED Luminaire." Frecska teaches a luminaire having multiple movable LED strips in a large fixture. It is for its teachings of LED arrays, electronics, drivers, and fixtures that U.S. Pat. No. 7,311,423 is herein incorporated by reference in its entirety.

U.S. Pat. No. 7,476,004 by Chan issued on Jan. 13, 2009 and is titled "LED Lighting Lamp Tube." Chan teaches LED arrays mounted in tubes and configured to replace fluorescent light tubes in fluorescent fixtures. Replacements such as Chan's have provided an early upgrade path for commercial lighting in the move from fluorescent to LED. It is for its teachings of LED arrays, electronics, drivers, and fixtures that U.S. Pat. No. 7,476,004 is herein incorporated by reference in its entirety.

U.S. patent application Ser. No. 13/383,917 by Burrow et al. published as US 20120113628 on May 10, 2012 and is titled "Light Emitting Diode Retrofit Conversion Kit for a Fluorescent Light Fixture." Burrow also teaches LED arrays configured to replace fluorescent light tubes in fluorescent fixtures. Replacements such as Burrow's have provided an early upgrade path for commercial lighting in the move from fluorescent to LED. It is for its teaching s of LED arrays, electronics, drivers, and fixtures that US 20120113628 is herein incorporated by reference in its entirety.

U.S. patent application Ser. No. 13/075,494 by Handsaker published as US 20120250309 on Oct. 4, 2012 and is titled "LED Lighting Fixture With Reconfigurable Light Distribution Pattern." Handsaker teaches modular LED arrays with reconfigurable lenses and a fixture with an extruded aluminum base. It is for its teachings of LED arrays, electronics, drivers, and fixtures that US 20120250309 is herein incorporated by reference in its entirety.

U.S. patent application Ser. No. 13/473,929 by Araki, et al. published as US 20120320627 on Dec. 20, 2012 and is titled "Flat Panel Lighting Device and Driving Circuitry." Araki teaches modular LED arrays and drivers configured in a relatively thin flat frame that can be edge lit. It is for its teachings of LED arrays, electronics, drivers, and fixtures that US 20120320627 is herein incorporated by reference in its entirety.

U.S. patent application Ser. No. 14/210,991 by Ishii published as US 20150016100 on Jan. 15, 2015 and is titled "Luminaire." Ishii teaches a fixture having an LED array and drivers with a long lens covering the electronic components. It is for its teachings of LED arrays, electronics, drivers, and fixtures that US 20150016100 is herein incorporated by reference in its entirety.

As can be inferred by this background section, the prior art discloses luminaires that can be used commercially, but that the overall packaging, fixtures, drivers, interconnects, and designs are still evolving. Systems and methods that provide commercial LED lighting with advanced packaging, fixtures, drivers, interconnects, and designs are needed.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is an aspect of the embodiments that a luminaire has an extruded housing. The housing can be formed from an extrusion, such as an aluminum extrusion. Extrusion is a process of shaping material by forcing it to flow through a shaped opening in a die. The extruded material, often called an extrusion, emerges as an elongated piece having a profile that is substantially identical to the profile of the die opening. The profile has width and height dimensions. The extrusion and extruded housing formed from the extrusion also have a length that is the distance between the first end and the second end of the extrusion/extruded housing. As such, the second end is distanced from the first end by the length.

The profile has features for forming the extrusion's plurality of length running elements. As such, the length running elements are generally parallel to one another and run the complete length of the extrusion. The length running elements can include a cross member connecting two curved sides, two lens channels, two LED array channels, four side lens channels, and two fixture bracket supports. An extruded housing produced from the extrusion can have window openings cut into the two sides.

It is another aspect of the embodiments to use the extruded housing as a luminaire component. An LED array, a lens, and two side lenses can be slid into one end of the extruded housing and held in the extruded housing by two endcaps, the first endcap and the second endcap. In general, an endcap can be attached to either the first end or the second end of the housing. The LED array can be a circuit board to which a plurality of LEDs is mounted with the circuit board providing electricity to the LEDs. The LED array can be slid into the LED array channels. The LED array channels can be positioned directly under the cross member. In some embodiments, a thermal compound between the LED array and the cross member can facilitate the transfer of heat from the LEDs into the housing. The lens is typically a transparent, translucent, or frosted optical element that is slid into the lens channels and parallel to the LED array. Light from the LEDs can pass through the lens to thereby provide illumination. The side lenses are also typically transparent, translucent, or frosted optical elements. Each side lens can be slid into two of the side lens channels such that each side lens is inside the housing, is parallel to, and is adjacent to one of the two sides.

It is yet another aspect of the embodiments that the luminaire can have fixture brackets from which the luminaire can be suspended. As discussed above, the fixture bracket supports can run the length of the housing and are parallel to one another. A fixture bracket can be positioned partially below the fixture bracket supports with the fixture bracket's ends under the fixture bracket supports and its center in the space between the fixture bracket supports. As such, the luminaire can be held aloft by the fixture brackets. For example, the luminaire can hang from suspension cables attached to the center area of the fixture brackets. Holes in the center area of the fixture brackets can accommodate threaded nipples and lock nuts can keep the threaded nipples securely positioned within the holes and thereby attached to the fixture brackets. The luminaire can be suspended by the threaded nipples. For example, the aforementioned suspension cables can be attached to the threaded nipples and be thereby attached to the fixture brackets.

It is a further aspect of the embodiments that a housing cover covers a top opening. The top opening is an opening above the cross member, between the two curved sides, and above the fixture bracket supports. Typically, there is a wireway above the cross member and between the two curved sides. Internal wires for powering and controlling the luminaire can be routed through the wireway. Wireway openings in the housing cover can provide access for passing wires into the luminaire.

It is a still further aspect of the embodiments that a wireway cover can cover a wireway opening. Wireway covers can typically be easily removed and reinstalled to thereby cover and uncover a wireway opening. A wireway cover can simply cover the wireway opening and block access to the wireway. Alternatively, a wireway cover can have a knockout that can be pushed free or knock out of the wireway cover to produce a hole in the wireway cover. Wires can pass through the hole in the wireway cover and into the top opening and the wireway. A wireway cover can use an electrical connector for passing electric power or signals into the luminaire. An electric cable, such as a shielded cable or Ethernet cable can provide electric power and/or signals to the electrical connector, thereby powering and/or controlling the luminair.

The electrical connector can be a panel feedthrough terminal block. For example, electrical power can be provided to the luminaire by an electric cable having at least two distinct conductors. Here, distinct conductor means insulated from one another such as an insulated wire and a bare wire or two insulated wires. In practice, the electric cable would have a power line, a return line, and possibly a ground line. The power line and return line are typically insulated wires while the ground line can be either a bare wire or an insulated wire. A 18/2 shielded cable is an example of an electric cable. The terminal block can be attached to a wireway cover or endcap and can be configured to pass electrical power from external wiring and into the internal wiring and circuitry of the luminaire. An 18/2 shielded cable is a shielded cable with two 18 gauge insulated wires and an internal shield covered by an outside insulator. The cable's shield, or a third wire in an alternative embodiment, can provide a ground connection. Electricians and those knowledgeable of electric wiring or the installation of electrical components are familiar with shielded cables and terminal blocks such as panel feed through terminal blocks.

Using an RJ45 socket as the electrical connector provides for using Ethernet cables to supply the luminaire with electric power or signals. Power Over Ethernet (POE) is a known set of standards for supplying power and signals to computer network equipment via Ethernet cables. An RJ45 socket has a row of eight connectors. A luminaire can be powered via POE or can be powered by simply running power with no signals into two or more of those connectors. For example, the power line can connect to the leftmost four connectors while the return line can connect to the rightmost four connectors. In such embodiments, an RJ45 power circuit that includes the RJ45 socket can be fixedly attached to the wireway cover while a hole in the wireway cover provides access to the RJ45 socket. Embodiments can pass power through an endcap by, for example, fixedly attaching the RJ45 power circuit to an endcap while a hole in the endcap provides access to the RJ45 socket.

Using an IMS chassis connector as the electrical connector provides for using IMS cables to supply the luminaire with power and control signals. When using an IMS chassis connector, electrical power can pass via two conductors and control signals can pass via two different conductors. As such, the IMS cable has at least four wires that can be electrically connected to four contacts in the IMS chassis connector. The IMS chassis connector thereby provides for passing electric power via two wires and passing control signals via two different wires into and out of the luminaire.

A wireway cover can be attached to the housing cover by one or more screws or other fasteners. A downward bend and tab arrangement can hold one end of the wireway cover in the wireway opening such that a single screw in the opposite end can fix the wireway cover in place.

It is still yet another aspect of the embodiments that the profile can be symmetric about a center line parallel to the height and the curved sides can curve into the profile to give the profile a bell-like appearance. The upper side of the cross member can be ribbed. For example, the profile can be designed to produce ribs running the length of the extrusion and parallel to LED array channels and other length running elements.

It is a still yet further aspect of the embodiments that the luminaire can be controlled by a motion sensor. For example, a motion sensor can be mounted on and powered by the LED array's circuit board such that the motion sensor detects movement under the luminaire. Upon detecting motion, the motion sensor can trigger or close a switch. The switch, upon closing or being triggered, can complete a circuit to thereby provide power to the LEDs. Here, the motion sensor causes the switch to close which causes the LEDs to illuminate.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 7 illustrates a luminaire with housing cover and wireway covers absent in accordance with aspects of the embodiments;

FIG. 8 illustrates a bracket assembly in accordance with aspects of the embodiments;

FIG. 9 illustrates a wireway cover in accordance with aspects of the embodiments;

FIG. 10 illustrates a housing cover in accordance with aspects of the embodiments;

DETAILED DESCRIPTION

Figure 1:
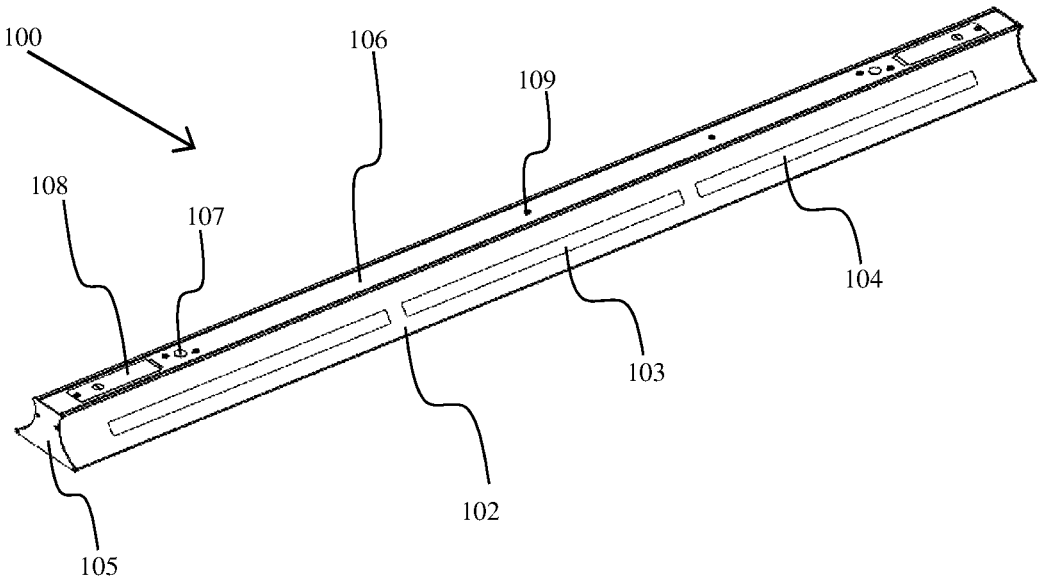
FIG. 1 illustrates a luminaire with an internal power supply in accordance with aspects of the embodiments.

The particular values and configurations discussed in these non-limiting examples can be varied and are cited merely to illustrate at least one embodiment and are not intended to limit the scope thereof.

For a general understanding of the present disclosure, reference is made to the drawings. In the drawings, like reference numerals have been used throughout to designate identical elements. In describing the present disclosure, the following term(s) have been used in the description.

A luminaire for industrial and warehouse applications can be assembled using an extruded housing having curved sides connected by a cross member. Window openings in the curved sides can allow light to exit toward the sides of the luminaire while most of the light exits through a lens on the bottom. The extrusion can have channels and slots such that optical elements and an LED array can be slid into the housing and retained by endcaps. A housing cover can overlie a wireway while being held in place by screws creating a clamping force between the housing cover and fixture brackets retained within the housing. The luminaire can be suspended by the fixture brackets or by elements attached to the fixture brackets.

FIG. 1 illustrates a luminaire 100 with an internal power supply in accordance with aspects of the embodiments. The luminaire's main structural element is an extruded housing 102. A side lens 103 is visible through three window openings 104 in the curved side of the extruded housing 102. An endcap 105 is attached to an end of the extruded housing 102. A housing cover 106 is attached to the extruded housing over the top opening and wireway. The wireway can be accessed by removing a wireway cover 108. A hole in the housing cover is above a threaded nipple and fixture bracket (not visible) while a removable plug 107 blocks the hole. The internal power supply (not visible) is attached to the housing cover 106 by a screw 109.

Figure 2:
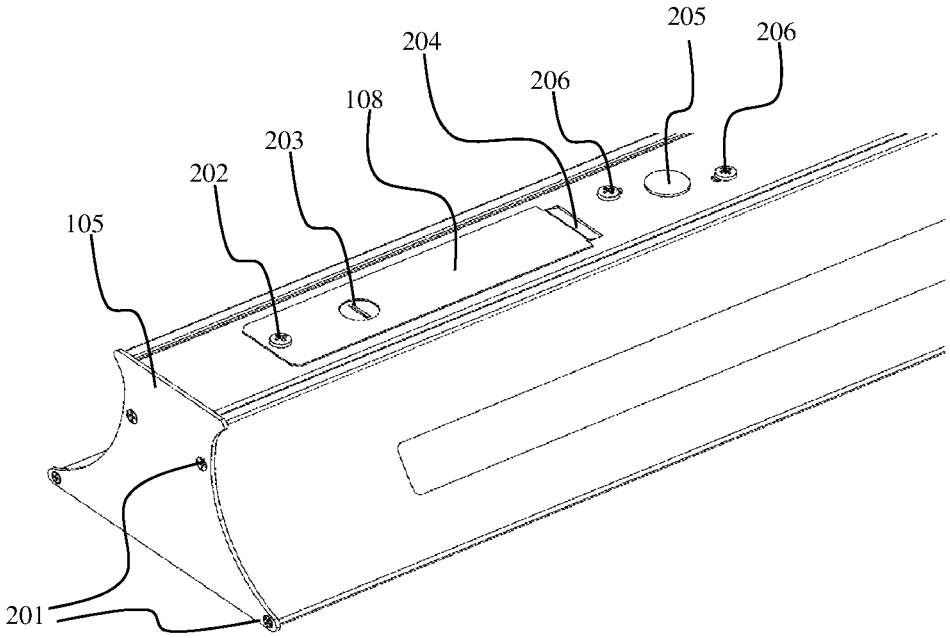
FIG. 2 illustrates a luminaire endcap on a luminaire in accordance with aspects of the embodiments.

FIG. 2 illustrates a luminaire endcap 105 on a luminaire 100 in accordance with aspects of the embodiments. The embodiment illustrated in FIG. 2 depicts endcap 105 attached to the extruded housing 102 by four screws 201. The wireway cover 108 is seen to have a knockout 203 and to be secured on one side by a screw 202. A downward bend 204 at the other side of the wireway cover 108 can be seen passing underneath the housing cover 106 such that both ends of the wireway cover 108 are held in place. The wireway cover can be released from the housing cover 106 by removing screw 202. Plug 205 seals the housing cover 106 and, in most embodiments, can be pulled out of its hole to allow access to the fixture bracket, threaded nipple underneath, or other mechanism underneath. Screws 206 pass through the housing cover 106 and attaches to a fixture bracket, perhaps by threading into threaded holes in the fixture brackets. Screws 206 can perform the functions of holding the housing cover 106 in place and of simultaneously holding the fixture brackets in place. The embodiment illustrated in FIGS. 1 and 2 have two fixture brackets and two screws 206 attached to each fixture bracket.

Figure 3:
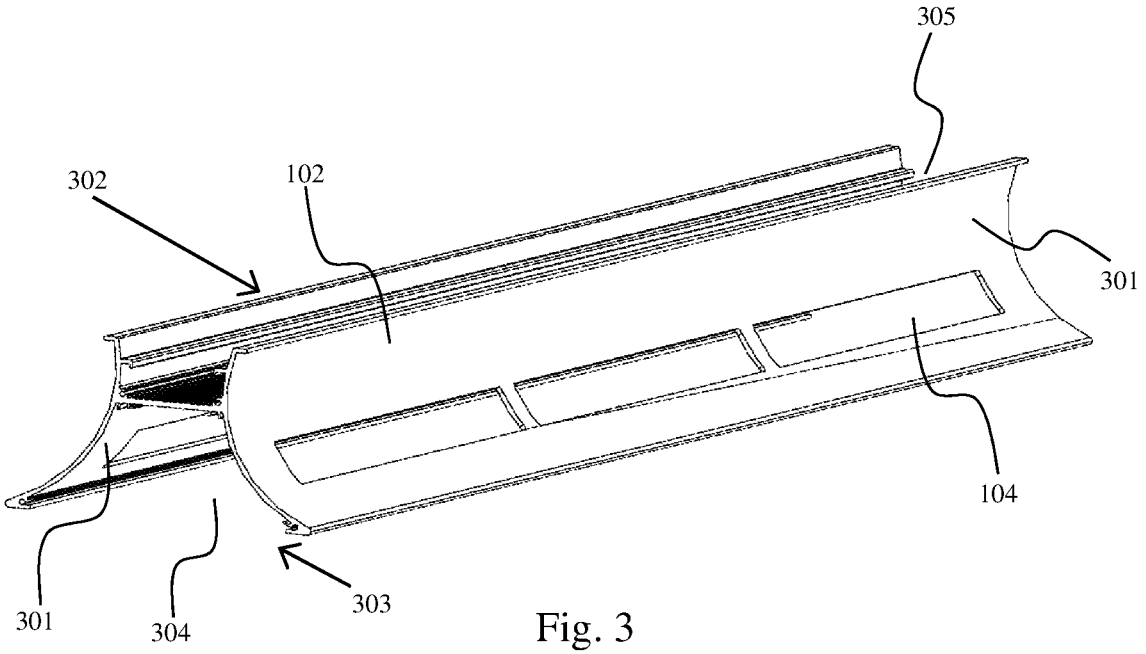
FIG. 3 illustrates an extruded housing with three window openings in accordance with aspects of the embodiments.

FIG. 3 illustrates an extruded housing 102 with three window openings 104 in accordance with aspects of the embodiments. The housing 102 has a top 302, a bottom 303, a lower cavity 304, and a wireway 305. The extruded housing 102 can be formed by passing material through a die to form an extrusion, cutting the extrusion to length, and cutting at least two window openings 104 into the curved sides 301 of the extrusion. The curved sides 301 in the illustrated embodiment are concave because the curved sides curve into the extruded body. Another way to describe the concave shape is that the bottom ends of the curved sides 301 curve away from a centerline of the extrusion's profile wherein the centerline bisects the cross member and is perpendicular to the cross member. The sides 301 are connected by the cross member 402 to create the wireway 305 above the cross member 402 and the lower cavity below the cross member.

Figure 4:
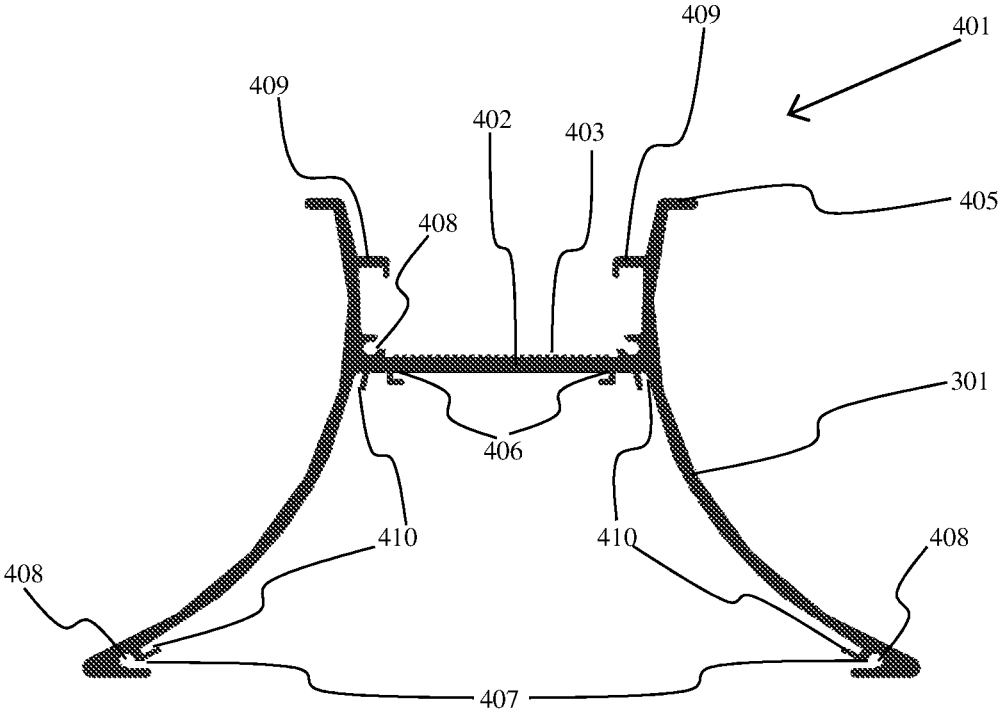
FIG. 4 illustrates a profile of an extrusion in accordance with aspects of the embodiments.

FIG. 4 illustrates a profile 401 of an extrusion in accordance with aspects of the embodiments. The profile has two curved sides 301 joined by a cross member 402. The illustrated cross member 402 has ribs 403 produced by a rib pattern in the die used to produce the extrusion. Two LED array slots 406 are directly underneath the cross member 402 such that an LED array can be slid into the LED array slots 406 and thereby held in place under the cross member 402. Two lens slots 407 at the bottoms of the curved sides 301 can hold a lens at the bottom of the luminaire. Screws 201 can be threaded into screw holes 408 at the outer extent of the lens slots 407 to attach endcap 105 to the extruded housing. Similar screw holes 408 positioned at the joint of the cross member 402 and curved sides 301 can also accommodate screws attaching endcap 105 to the extruded housing. Fixture brackets can mate with the undersides of fixture bracket supports 409 and span the distance between the fixture bracket supports 409. As such, the luminaire can be hoisted by fixture brackets installed under the fixture bracket supports 409. The illustrated embodiment has ledges 405 at the top of the curved sides 301 and extend outward. Side lenses can be slid into the side lens slots 410 at the inside edges of the curved sides 301.

Figure 5:
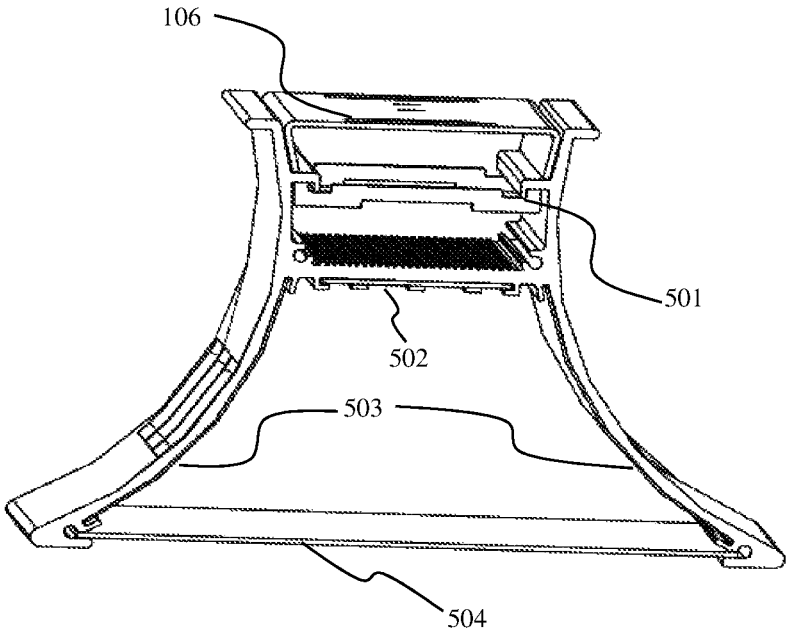
FIG. 5 illustrates a partially populated extruded housing in accordance with aspects of the embodiments.

FIG. 5 illustrates a partially populated extruded housing 102 in accordance with aspects of the embodiments. A housing cover 106 forms the top of the luminaire by covering the space between the curved sides 301 and above the fixture bracket supports 409. A fixture bracket 501 is installed under the fixture bracket supports 409. An LED array 502 has been slid into the LED array slots 406. Two side lenses 503 have been slid into side lens slots 410 such that light from the LED array 502 can pass thought the side lenses 503, then through the window openings 104 in the housing 102, and then out of the luminaire. Similarly, lens 504 has been slid into lens slots 407 such that light from the LED array 502 can pass through lens 504 and then out the bottom of the luminaire. Lens 504 and side lenses 503 are optical elements though which light can pass. Examples of such optical elements include, but are not limited to, transparent, translucent, or frosted sheets of plastic or glass. The side lenses 503 can be formed from materials that can bend to match the curve of the curved sides 301.

Figure 6:
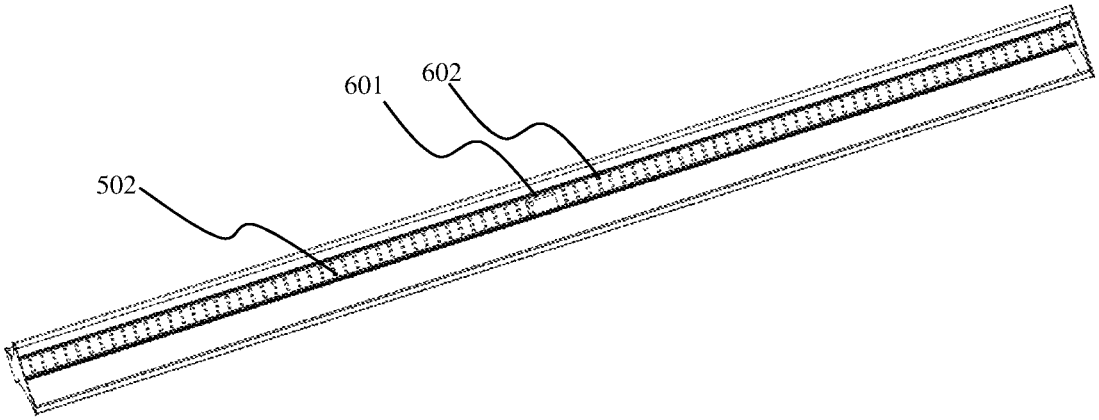
FIG. 6 illustrates a luminaire with an LED array and motion sensor on a circuit board in accordance with aspects of the embodiments.

FIG. 6 illustrates a luminaire with an LED array 502 and motion sensor 601 on a circuit board 602 in accordance with aspects of the embodiments. The view of FIG. 6 is from the bottom of the luminaire. The lens 504 is not installed such that the LED array 502 can be seen. As used here, "LED array" refers to the circuit board 602 and LED diodes attached to the circuit board 602. The motion sensor 601 can also be mounted to the circuit board 602. The motion sensor 601 can receive electrical power via the circuit board 602 and can control a switch 703, shown in FIG. 7, that turns the LED array on or off. When the LED array is turned on, the LED diodes in the LED array receive electrical power and emit light. When the LED array is turned off, the LED diodes in the LED array receive do not receive electrical power. The motion sensor can receive electrical power whenever the luminaire receives electrical power.

FIG. 7 illustrates a luminaire with housing cover 106 and wireway covers 108 absent in accordance with aspects of the embodiments. Two fixture bracket assemblies 701 are positioned between the fixture bracket supports 409. Switch 703 and power supply 702 are positioned in the luminaire's wireway. Switch 703 can be controlled by motion sensor 601. Screws 109 can secure power supply 702 to the wireway cover. Embodiments having a power supply such as power supply 702 can accept electrical power in the form of wall current (e.g., 110 VAC, 220 VAC, etc.) and can supply conditioned DC power to other components such as LED array 502, motion sensor 601, switch 703, etc. In some embodiments, motion sensor 601 and switch 703 can receive line current and can switch on or off the electrical input provided to the power supply.

FIG. 8 illustrates a fixture bracket assembly in accordance with aspects of the embodiments. A lock nut 802 attaches threaded nipple 801 to fixture bracket 501. Screws 206 can pull housing cover 106 (not shown) towards fixture bracket supports 409 and can pull the fixture bracket 501 into fixture bracket support 409. In this manner, screws 206 produce a clamping force that holds the fixture brackets and the housing cover in position within the luminaire 100. The luminaire 100 can be suspended by bolts, threaded rods, or other element attached to the threaded nipples 801 because lifting the threaded nipples 801 lifts the fixture brackets 501 which lifts the fixture bracket supports 409 which lifts the housing 102.

FIG. 9 illustrates a wireway cover 108 in accordance with aspects of the embodiments. Knockout 203 can be removed to thereby provide a route for running a wire into the wireway, which is the space between the cross member 402 and the housing cover 106. The tabbed end of the wireway cover 108 has tabs 901 and a downward bend 204 that can fit inside the wireway opening 1001, shown in FIG. 10, of a housing cover 106. The rest of the wireway cover 108 is sized to fit over and cover the wireway opening 1001. A screw 202 attaches one end of the wireway cover 108 to the housing cover 106 while the downward bend 204 and tabs 901 keeps the other end of the wireway cover from pulling out of the wireway opening 1001. The wireway cover 108 can be released from the housing cover 106 by removing screw 202.

FIG. 10 illustrates a housing cover 106 in accordance with aspects of the embodiments. Wireway openings 1001 can provide access to a wireway. Plug holes 1002 are positioned directly above the fixture brackets 501 or threaded nipples 801 such that the fixture brackets 501 or threaded nipples 801 can be accessed after removing plugs 205, if necessary. Screws 109 can pass through holes 1003 to attach power supply 702 to the housing cover 106.

Figure 11:
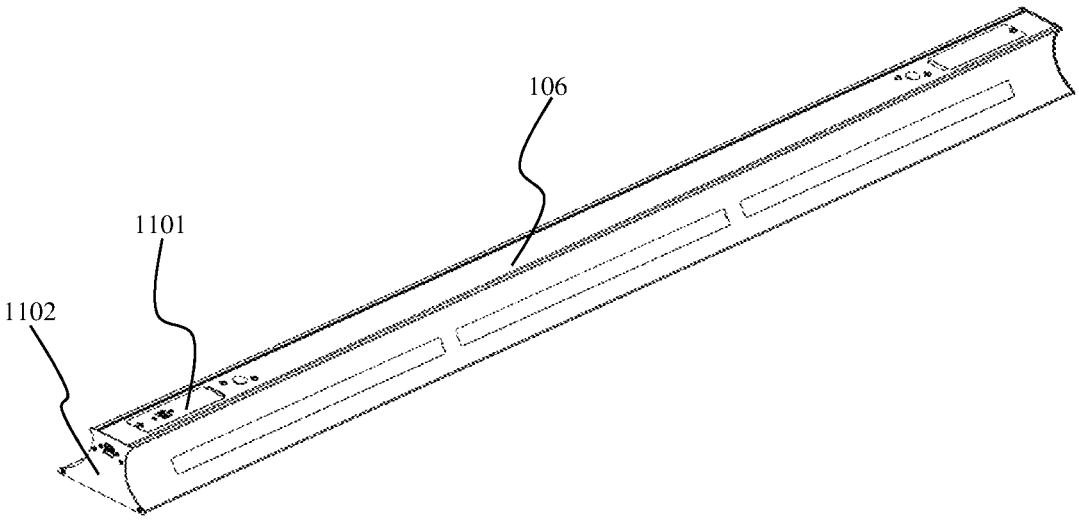
FIG. 11 illustrates a luminaire configured to receive electrical power through an RJ45 socket in accordance with aspects of the embodiments.

FIG. 11 illustrates a luminaire configured to receive electrical power through an RJ45 plug in accordance with aspects of the embodiments. RJ45 sockets can be elements of wireway covers 1101 having RJ45 connector assemblies. RJ45 sockets can also be elements of endcaps 1102 having RJ45 connector assemblies. Wireway cover 1101 and endcap 1102 have openings such that an RJ45 plug can be socketed into the RJ45 socket. In this manner, power can be supplied to the luminaire 100 by way of a cable having an RJ45 plug on at least one end.

Figure 12:
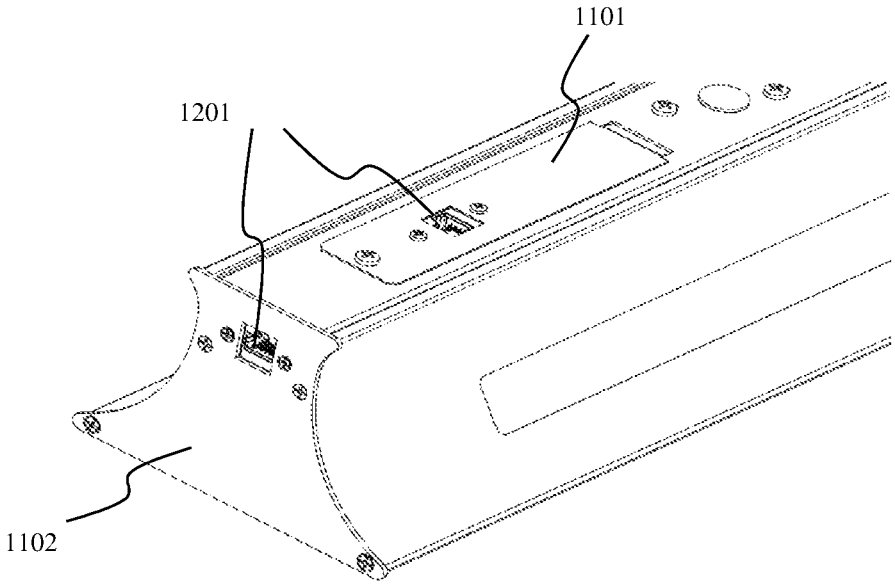
FIG. 12 illustrates a luminaire end with RJ45 connector assemblies in accordance with aspects of the embodiments.

FIG. 12 illustrates a luminaire end with RJ45 connector assemblies in accordance with aspects of the embodiments. The RJ45 sockets can be seen through holes in the openings of wireway cover 1101 and endcap 1102.

Figure 13:
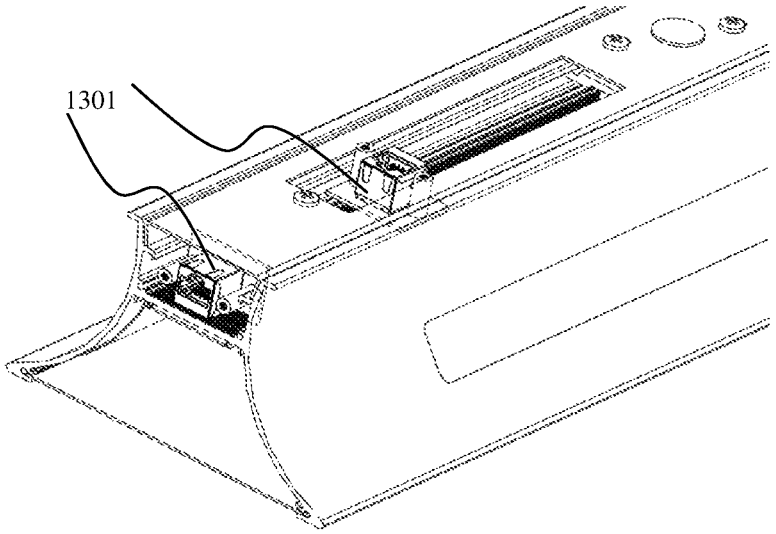
FIG. 13 illustrates RJ45 connector assemblies positioned in a luminaire in accordance with aspects of the embodiments.

FIG. 13 illustrates RJ45 connector assemblies 1301 positioned in a luminaire in accordance with aspects of the embodiments. FIG. 13 is an illustration of the luminaire of FIG. 12 with wireway cover 1101 and endcap 1102 absent to thereby reveal the RJ45 connector assemblies 1301.

Figure 14:
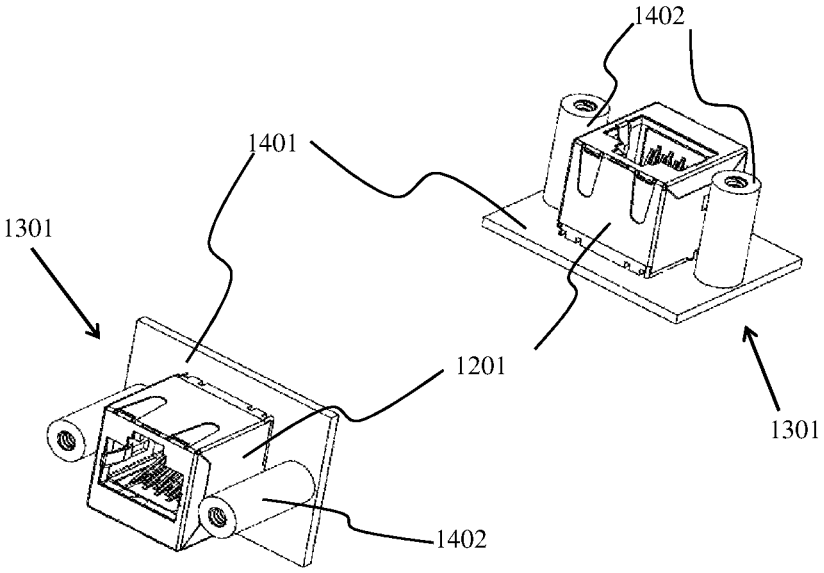
FIG. 14 illustrates RJ45 connector assemblies in accordance with aspects of the embodiments.

FIG. 14 illustrates RJ45 connector assemblies 1301 in accordance with aspects of the embodiments. RJ45 sockets 1201 are attached to input circuit boards 1401. The RJ45 connector assemblies 1301 and be attached to wireway cover 1101 or endcap 1102 by screws threaded into standoffs 1402.

Figure 15:
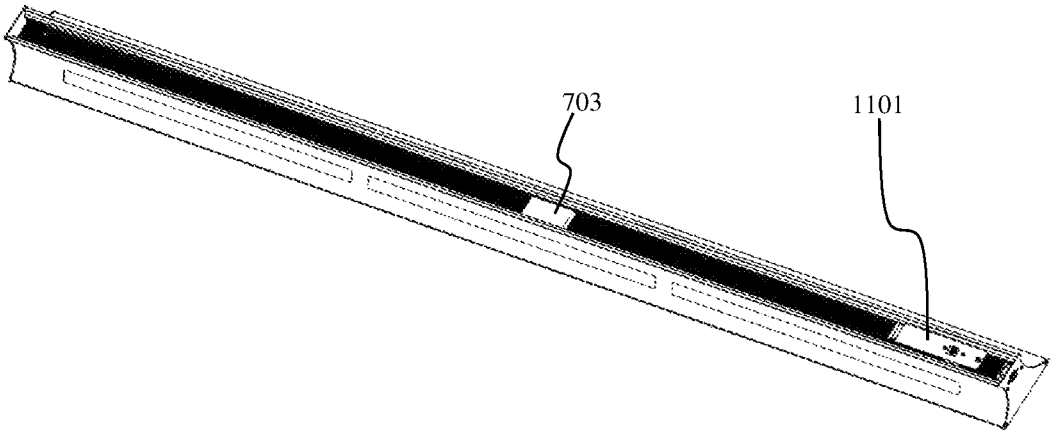
FIG. 15 illustrates a luminaire with a switch controlled by a motion sensor in accordance with aspects of the embodiments.

FIG. 15 illustrates a luminaire with a switch 703 controlled by a motion sensor 601 in accordance with aspects of the embodiments. This embodiment lacks an internal power supply and must therefore be connected to an external power supply. An external power supply can provide conditioned DC power to the luminaire via the RJ45 sockets in wireway cover 1101.

Figure 16:
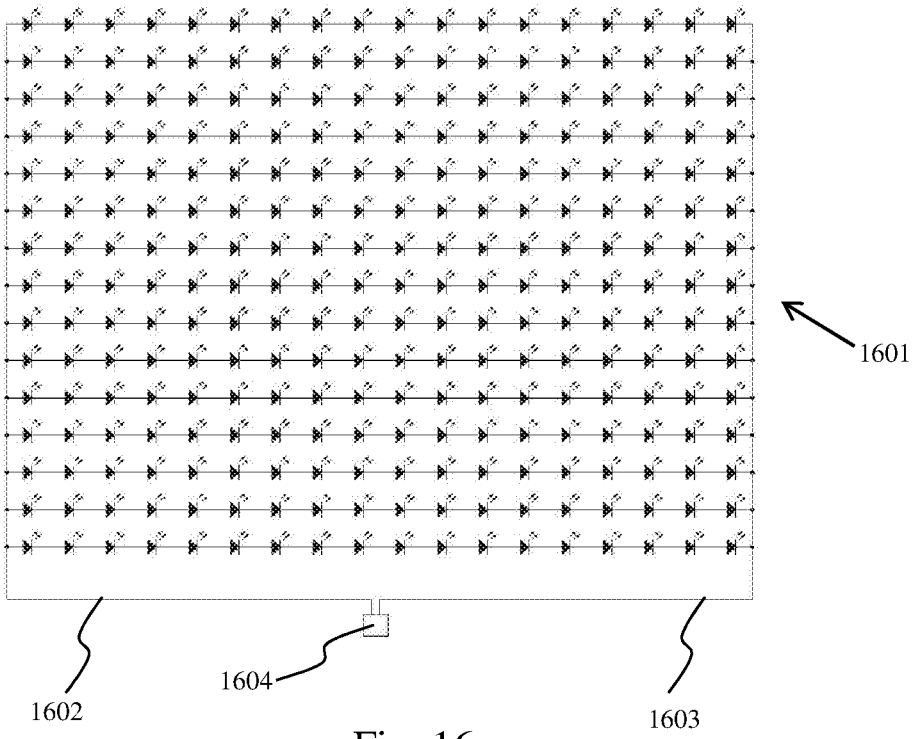
FIG. 16 illustrates an LED array circuit in accordance with aspects of the embodiments.

FIG. 16 illustrates an LED array circuit 1601 in accordance with aspects of the embodiments. The circuit is provided as an example and is not intended to be limiting. The illustrated circuit has fifteen rows of diodes. Each row is electrically connected in parallel to the other rows. Each row has eighteen LEDs connected in series. A two-wire connector 1604 provides connectivity to a positive line 1602 and a negative line 1603. Those practiced in electronics are well versed in powering LEDs.

Figure 17:
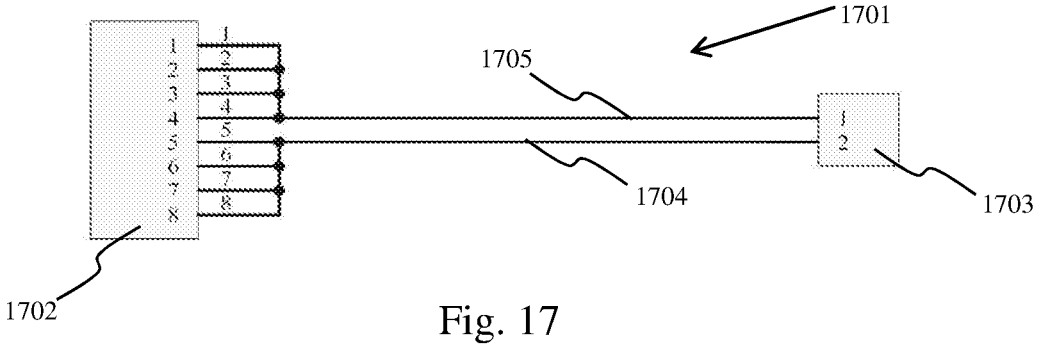
FIG. 17 illustrates an RJ45 power circuit in accordance with aspects of the embodiments.

FIG. 17 illustrates a RJ45 power circuit 1701 in accordance with aspects of the embodiments. The non-limiting embodiment of FIG. 17 has two connectors 1702, 1703 and two wires 1704, 1705. RJ45 plugs and sockets are well known and standardized electrical components. RJ45 socket 1702 has eight contacts in a single row. The first four RJ45 contacts in the row are labeled 1-4 and are electrically connected to a first wire 1705. The second four RJ45 contacts are labeled 5-8 and are electrically connected to a second wire 1704. The second connector 1703 has two contacts with the first, labeled 1, connected to the first wire 1705 and the second, labeled 2, connected to the second wire 1704. Wires 1704 and 1705 can be loose wires having conductors encapsulated in flexible insulator material or can be circuit board traces. The RJ45 plug pairs with an RJ45 socket. The RJ45 socket comprises a row of eight sequentially arranged contacts comprising a first four sequential contacts and a second four sequential contacts. The first four sequential contacts can be directly electrically connected together by the RJ45 power circuit. The second four sequential contacts can also be directly electrically connected together by the RJ45 power circuit.

Figure 18:
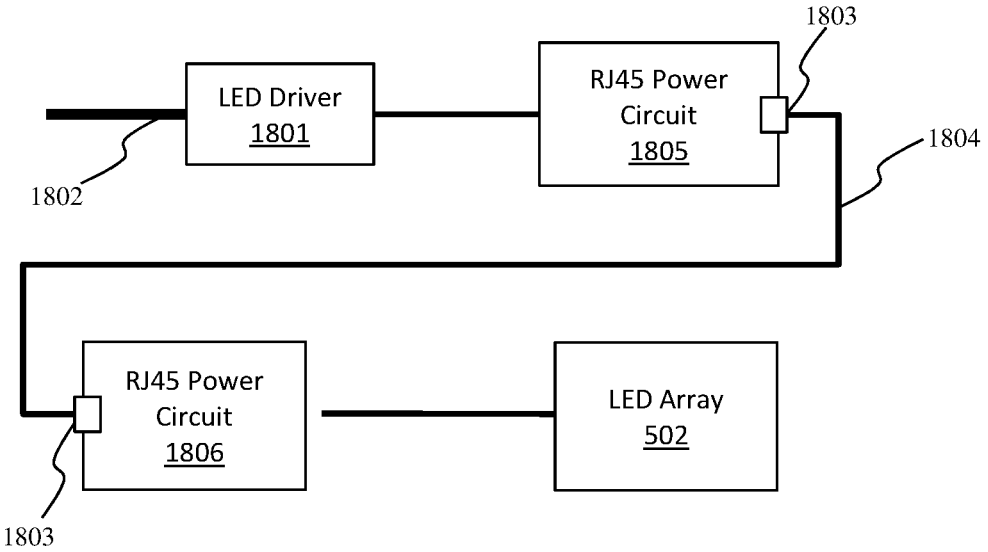
FIG. 18 illustrates a remote LED driver powering an LED array in accordance with aspects of the embodiments.

FIG. 18 illustrates a remote LED driver 1801 powering an LED array 502 in accordance with aspects of the embodiments. The LED driver 1801 can be similar to power supply 702. As such, LED driver 1801 can accept electrical power in the form of wall current (e.g., 110 VAC, 220 VAC, etc.) and can supply conditioned DC power to other components such as LED array 502, motion sensor 601, switch 703, etc. Here, LED driver 1801 is converting input electrical power into a DC output that can be passed into the two contact connector 1703 of an RJ45 power circuit 1805. RJ45 power circuits 1805, 1806 can be the same as RJ45 power circuit 1701. An Ethernet cable 1804 having RJ45 plugs 1803 can carry the DC output from RJ45 power circuit 1805 to RJ45 power circuit 1806 when the RJ45 plugs 1803 are plugged into the RJ45 sockets 1702. The DC output of the LED driver 1801 can then be passed to LED array 502 via the two contact connector 1703 of RJ45 power circuit 1806.

Figure 19:
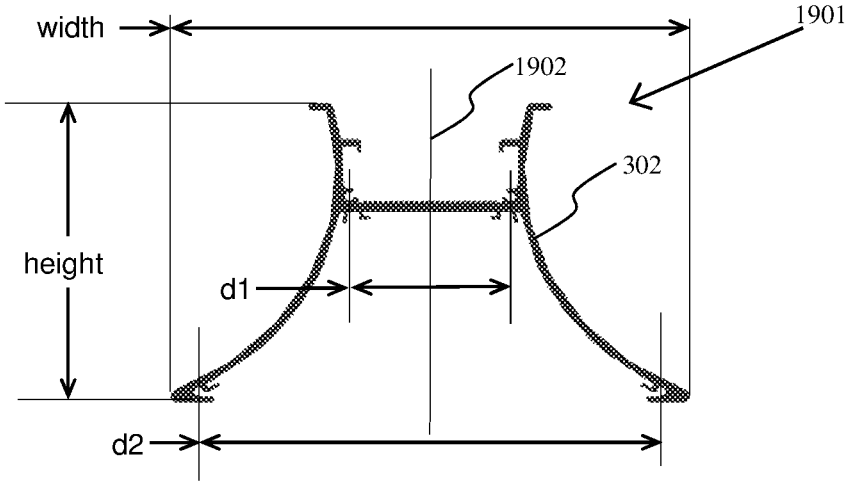
FIG. 19 illustrates a symmetric extrusion profile in accordance with aspects of the embodiments.

FIG. 19 illustrates a symmetric extrusion profile 1901 in accordance with aspects of the embodiments. The profile 1901 has a height and a width. A centerline 1902 is parallel to the height dimension and perpendicular to the width dimension. The symmetric extrusion profile 1901 is symmetric about the centerline 1902 which can be seen to be parallel to and bisect the cross member 402. Two distances are marked, d1 and d2. d1 is the distance the top two screw holes 408 while d2 is the distance between the bottom two screw holes 408. As discussed above, screw holes 408 accommodate screws 201 that attach the endcap 105 to the housing 102. The horizontal spacing of the endcap's screw holes can be slightly larger than d1 and d2 such that the endcap is slightly bowed or flexed when it is installed in the luminaire. Such bowing or flexing can help retain the endcap on the housing by putting force on screws 201. The curved sides 301 can also be seen to be concave because the curved sides 301 curve away from the centerline 1902 of the extrusion profile 1901.

Figure 20:
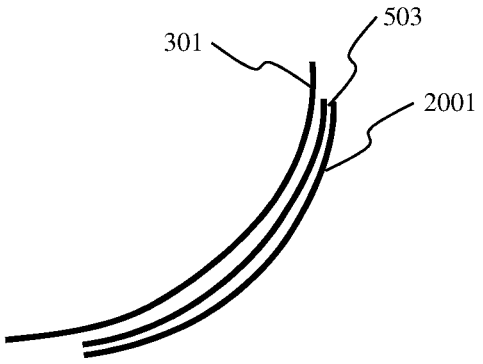
FIG. 20 illustrates a representation of a curved side, side lens, and reflector in accordance with aspects of the embodiments.

FIG. 20 illustrates a representation of a curved side 301, side lens 503, and reflector 2001 in accordance with aspects of the embodiments. The representation is inaccurate because there is space between the curved side 301 and side lens 503 and because there is space between the side lens 503 and the reflector 2001. In practice, the side lens 503 and reflector 2001 are slid into side lens channels 407 and, when installed, lie against each other and the curved side 301. The reflector 2001 can be formed from a thin flexible sheet having a reflective surface such that it reflects light from the LEDs back into the luminaire. The reflector 2001 can be cut to have windows matching the extruded housing's window openings 104. The reflector's windows can be sized and positioned such that light from the LEDs is not blocked by the reflector 2001 from exiting the window openings 104 of the housing 102.

Figure 21:
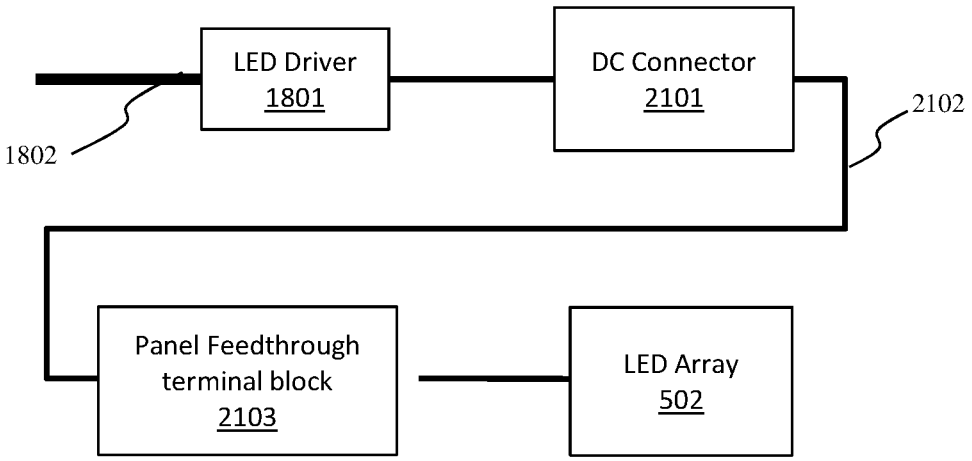
FIG. 21 illustrates a remote LED driver powering an LED array in accordance with aspects of the embodiments.

FIG. 21 illustrates a remote LED driver 1801 powering an LED array 502 in accordance with aspects of the embodiments. The LED driver 1801 can be similar to power supply 702. As such, LED driver 1801 can accept electrical power in the form of wall current (e.g., 110 VAC, 220 VAC, etc.) and can supply conditioned DC power to other components such as LED array 502, motion sensor 601, switch 703, etc. Here, LED driver 1801 is converting input electrical power into a DC output that can be passed into an electric cable 2102, such as an 18/2 shielded cable, by a DC connector 2101. The shielded cable 2102 can carry the DC output from DC connector 2101 to panel feedthrough terminal block 2103. In order to transmit power, the shielded cable 2102 is electrically connected to DC connector 2101 and to panel feedthrough terminal block 2103. A luminaire's internal wiring and circuitry can carry the electric power from panel feedthrough terminal block 2103 to LED array 502.

Figure 22:
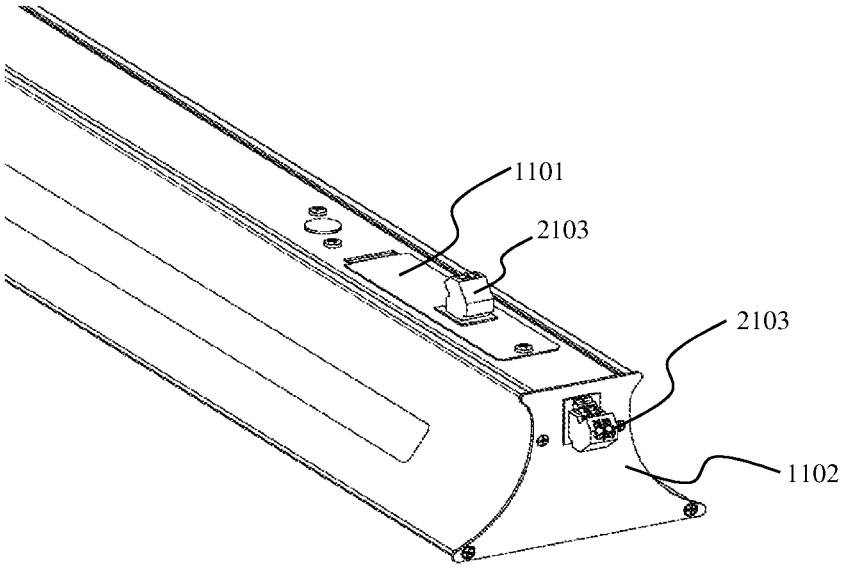
FIG. 22 illustrates a luminaire end with panel feedthrough terminal blocks accordance with aspects of the embodiments.

FIG. 22 illustrates a luminaire end with panel feedthrough terminal blocks 2103 accordance with aspects of the embodiments. A panel feedthrough terminal block is typically designed to be pressed into properly sized hole in a panel. When so pressed, the panel feedthrough terminal block locks in place and provides electrical connectivity from one side of the panel to the other. The illustrated terminal blocks 2103 have two internal terminals and two external terminal blocks. As such, the terminal block can electrically connect two wires on one side of a panel to two wires on the other side of the panel. As illustrated, the pass through terminal block is configured to pass electrical power from a two conductor external electric cable into the luminaire.

Figure 23:
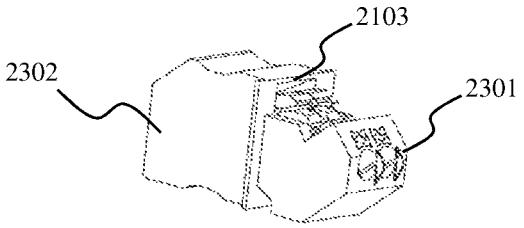
FIG. 23 illustrates a view of one of the panel feedthrough terminal blocks of FIG. 22.

FIG. 23 illustrates a view of one of the panel feedthrough terminal blocks 2103 of FIG. 22. The panel feedthrough terminal block 2103 has an internal end 2302 and an external end 2301. The panel feedthrough terminal block 2103 can electrically connect two external wires to two internal wires. The external wires can carry power and signals to the luminaire. The internal wires, being inside the luminaire, can carry power and signals inside the luminaire.

Figure 24:
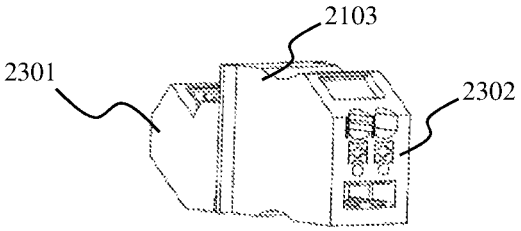
FIG. 24 illustrates a second view of one of the panel feedthrough terminal blocks of FIG. 22.

FIG. 24 illustrates a second view of one of the panel feedthrough terminal blocks 2103 of FIG. 22. As can be seen, the internal end 2302 has two terminals with each terminal electrically connected to one of the two terminals in the external end 2301.

Figure 25:
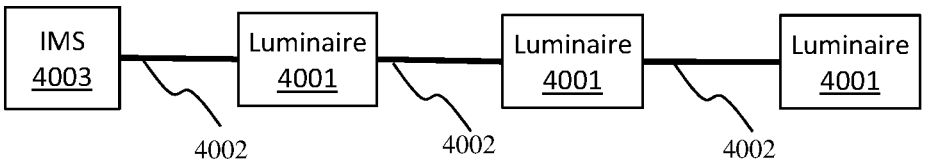
FIG. 25 illustrates an Illumination Management System (IMS) powering and controlling four luminaires in accordance with aspects of the embodiments.

FIG. 25 illustrates an Illumination Management System (IMS) 4003 powering and controlling four luminaires 4001 in accordance with aspects of the embodiments. An IMS 4003 can use IMS cables 4002 to provide power and control to the luminaires 4001. As shown in FIG. 25, the luminaires 4001 can be daisy chained with the IMS 4003 providing power and control signals to a first luminaire, the first luminaire passing the power and control signals to a second luminair, and so forth. An IMS can be connected to a building's mains power (e.g. 120 VAC or 240 VAC) and can produce conditioned DC power usable by the luminaires. IMS based lighting systems are advantageous because large AC-to-DC power blocks can be placed in the IMS such that the luminaires can be powered by small and inexpensive LED drivers that accept DC power and provide constant current power to the LEDs. The IMS can also control the luminaires by providing control signals.

Figure 26:
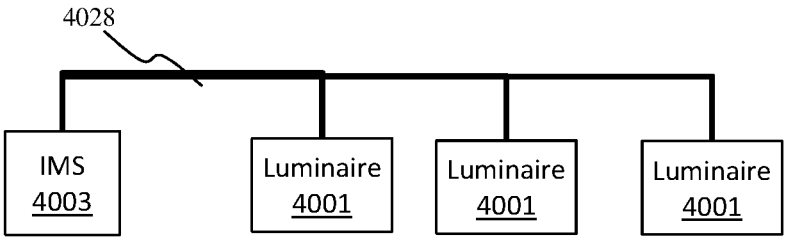
FIG. 26 illustrates an IMS powering and controlling four luminaires in accordance with aspects of the embodiments.

FIG. 26 illustrates an IMS 4003 powering and controlling four luminaires 4001 in accordance with aspects of the embodiments. Here, the IMS 4003 is connected to the luminaires by a multidrop IMS cable 4028 such that each of the luminaires 4001 receives power and control signals directly from the IMS 4003.

Figure 27:
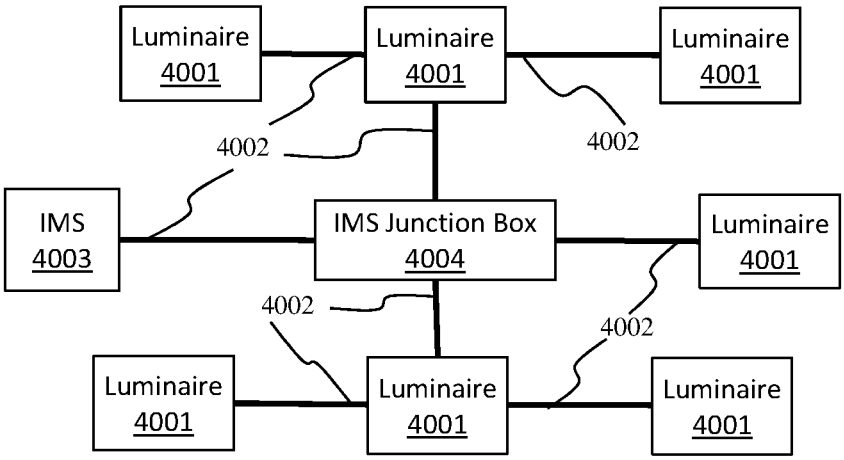
FIG. 27 illustrates an IMS powering and controlling seven luminaires in accordance with aspects of the embodiments.

FIG. 27 illustrates an IMS 4003 powering and controlling seven luminaires 4001 in accordance with aspects of the embodiments. The IMS 4003 is connected directly to an IMS junction box 4004 that distributes the power and control signals directly to three of the luminaires 4001. The remaining four luminaires 4001 receive the power and control signals directly from other luminaires. Alternatively, a multidrop IMS cable 4028 can be used instead of the combination of IMS cables 4002 and IMS junction box 4004.

Figure 28:
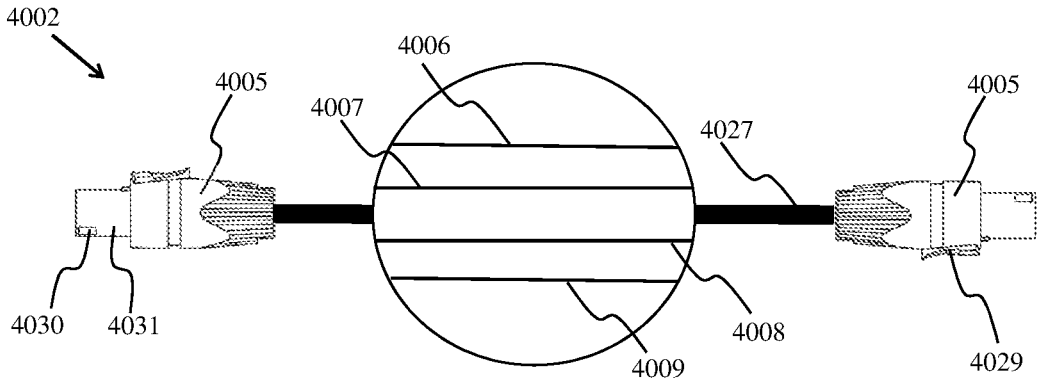
FIG. 28 illustrates an IMS cable in accordance with aspects of the embodiments.

FIG. 28 illustrates an IMS cable 4002 in accordance with aspects of the embodiments. IMS cable connectors 4005 are connected to either end of a four-conductor cable 4027. Two of the wires 4006, 4007 in the cable carry DC power with one wire 4006 being power (often labeled V+) and the other wire 4007 being the return line (often labeled V−). The other two wires 4008 and 4009 carry control signals. For example, the Digital Addressable Light Interface (DALI) is a well-known lighting standard that carries power and control signals over two wires with one called "+DALI bus" and the other called "−DALI bus". DALI, however, is limited to a maximum voltage of 22 VDC and a maximum current of 250 mA. The IMS system can therefore use DALI for control signaling on wires 4008 and 4009 while power is carried on wires 4006 and 4007. The IMS can provide 48 VDC at over 30 A which can be provided to the luminaires over wires 4006 and 4007. In practice, the IMS has operated with an output between 40 VDC and 52 VDC although 48 VDC plus/minus 1 VDC operation is preferred such that luminaires near the IMS do not receive too much voltage while luminaires far from the IMS, which can see less voltage due to transmission loss, receive enough voltage. Note that at least two conductors, such as wires 4006, 4007 can carry the DC power. More than two conductors can carry the DC power with more than one wire being power (V+) and/or more than one wire being return (V−). In such embodiments, the cable connectors and chassis connectors can have the same number of pins/sockets/contacts as the number of wires in the IMS cable. For example, an IMS cables with six wires can indicate the need for six contact connectors.

In this non-limiting example, the four conductors of cable 4027 are carrying V+, V−, +DALI, and −DALI. Wire 4006 carries V+. Wire 4007 carries V−. Wire 4008 carries +DALI. Wire 4009 carries −DALI.

Experimentation has shown that some connectors are advantageous when installing and operating a lighting system such as those of FIGS. 25-27 and especially for those installations having tens or hundreds of luminaires. Such systems are common in warehouses and data centers. The connectors should be installable by feel and should lock in place when properly installed. These properties are important because the connectors will often be manipulated by people on ladders and without a clear view (or with no view) of the operation they are trying to accomplish. For this reason, the IMS cable connector 4005 is shown as a Neutrik NL4FX cable connector which provides four electrical connections, a tactilely intuitive lock/release mechanism, and alignment keys. The Neutrik NL4FX pairs with chassis connectors 4010 such as the Neutrik NL4MD shown in FIGS. 29-36. The IMS cable connector 4005 can be installed in a IMS chassis connector 4010 by aligning its outer cylinder 4031 with the IMS chassis connector's cylindrical hole 4032, rotating until the key 4030 aligns with the IMS chassis connector's keyway 4034, and then pressing the IMS cable connector 4005 into the IMS chassis connector 4010 until the locking mechanism 4029 engages the IMS chassis connector's lock engagement 4033. These operations are easy to perform blind. Not shown is the IMS cable connector's center rod which fits in the IMS chassis connector's central hole 4035 when the IMS cable connector 4005 is installed in the IMS chassis connector 4010.

Figure 29:
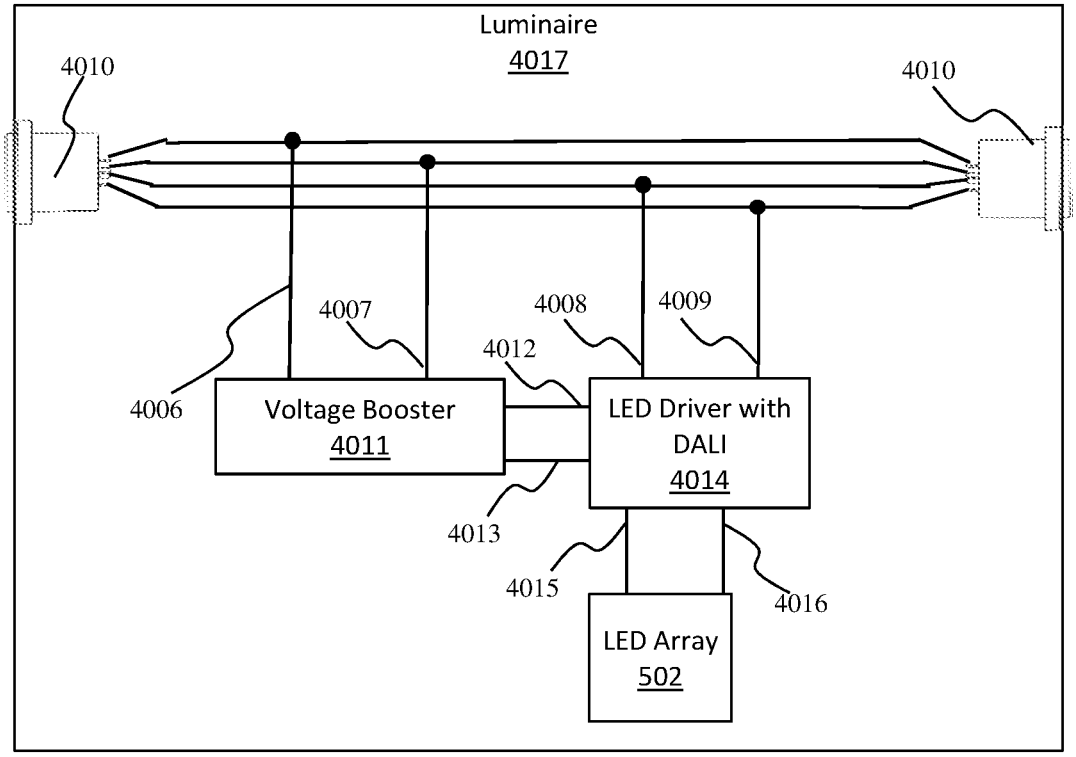
FIG. 29 illustrates a luminaire configured for power and control by an IMS in accordance with aspects of the embodiments.

FIG. 29 illustrates a luminaire 4017 configured for power and control by an IMS in accordance with aspects of the embodiments. The illustrated chassis connectors 4010 are the Neutrik NL4MD which mates with the NL4FX. V+ 4006 and V− 4007 are electrically connected to voltage booster 4011 which can provide a specified power on lines 4012, 4013 to the LED Driver 4014.+DALI 4008 and −DALI 4009 provide control signaling to the LED driver 4014. The LED driver 4014 powers the LED array 502 via LED power lines 4015, 4016. Being DALI enabled, LED driver 4014 is addressable such it can be commanded to turn LED array 502 on, off, or dimmed, etc. A single luminaire can have multiple LED drivers and LED arrays, each individually addressable and controllable via DALI. Although the DALI control signals can be provided by any device connected to the +DALI and −DALI lines, the IMS can house controllers that are accessible over the internet and that produce DALI signaling for the luminaires. This non-limiting example uses DALI instead of other two-wire control signaling protocols such as "0-10" (superseded by DALI).

The voltage booster 4011 accepts DC power at one voltage and outputs boosted DC power at a higher voltage than the input DC power. Those practiced in the electronics arts are familiar with numerous appropriate circuits such as boost converters, DC-DC converters, etc.

The LED driver 4014 in certain prototype luminaires have been the Mean Well LDD-700H-WDA, LDD-1050H-DA, and similar devices with DALI interfaces that are addressable and controllable via +DALI 4008 and −DALI 4009.

Figure 30:
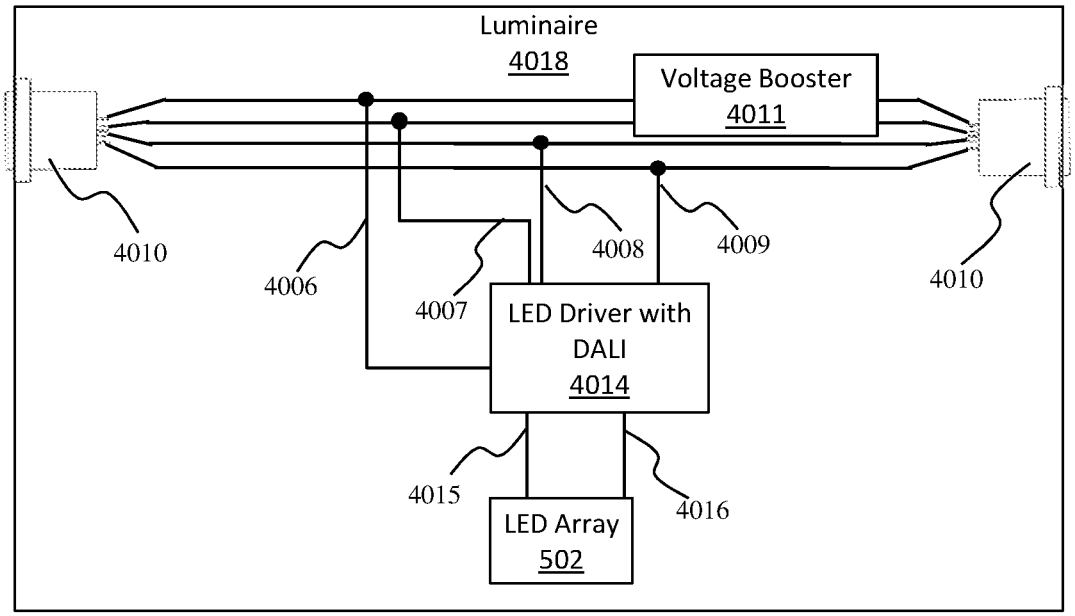
FIG. 30 illustrates a luminaire configured for power and control by an IMS in accordance with aspects of the embodiments.

FIG. 30 illustrates a luminaire 4018 configured for power and control by an IMS in accordance with aspects of the embodiments. Luminaire 4018 is similar to luminaire 4017 excepting that the voltage booster 4011 is configured to boost the voltage of the DC power passed from luminaire 4018 to another luminaire. Circuitry within or ancillary to the voltage booster can select a powered chassis connector 4010 as the power input and the other as the power output.

Figure 31:
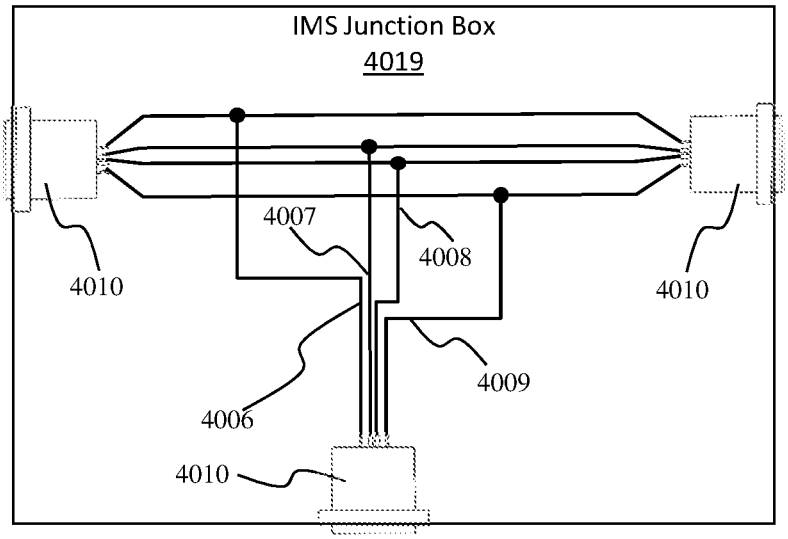
FIG. 31 illustrates an IMS junction box configured for power and control by an IMS in accordance with aspects of the embodiments.

FIG. 31 illustrates an IMS junction box 4019 configured use with an IMS 4003 in accordance with aspects of the embodiments. The junction box has three chassis connectors 4010. The IMS junction box 4019 directly electrically connects V+ on the chassis connectors using V+ wire 4006. The IMS junction box 4019 directly electrically connects V− on the chassis connectors using V− wire 4007. The IMS junction box 4019 directly electrically connects +DALI on the chassis connectors using +DALI wire 4008. The IMS junction box 4019 directly electrically connects −DALI on the chassis connectors using −DALI wire 4009. Other IMS junction boxes can have more than three chassis connectors that are similarly electrically connected.

Figure 32:
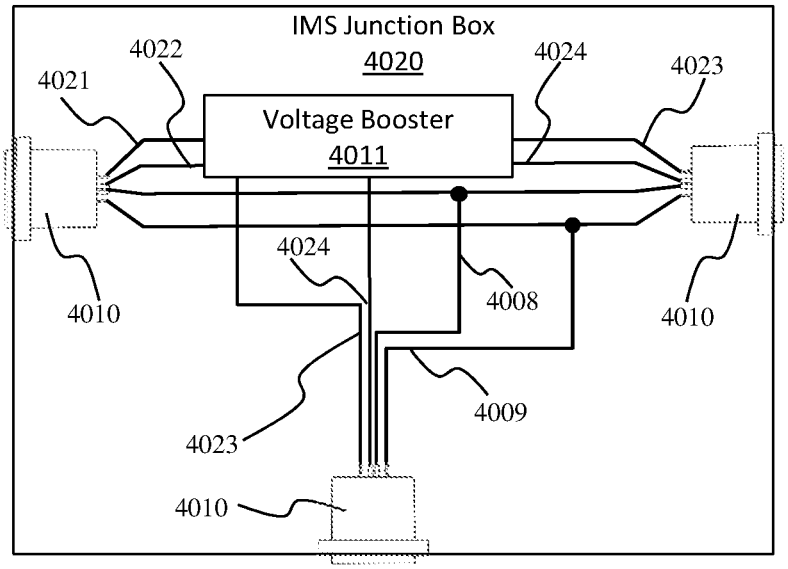
FIG. 32 illustrates an IMS junction box configured for power and control by an IMS in accordance with aspects of the embodiments.

FIG. 32 illustrates an IMS junction box 4020 configured for use with an IMS 4003 in accordance with aspects of the embodiments. The junction box has three chassis connectors 4010. The IMS junction box 4020 directly electrically connects +DALI on the chassis connectors using +DALI wire 4008. The IMS junction box 4020 directly electrically connects −DALI on the chassis connectors using −DALI wire 4009. As with luminaire 4018, IMS junction box 4020 boosts the voltage on the DC power lines. Here, DC power is received on wires 4021, 4022. DC power at a higher voltage is provided by the voltage booster on wires 4023 and 4024. Other IMS junction boxes can have more than three chassis connectors and additional voltage boosters that are similarly electrically connected.

Comparing the junction boxes 4019, 4020 and luminaires 4017, 4018 it can be seen that luminaires incorporate junction box functionality.

Figure 33:
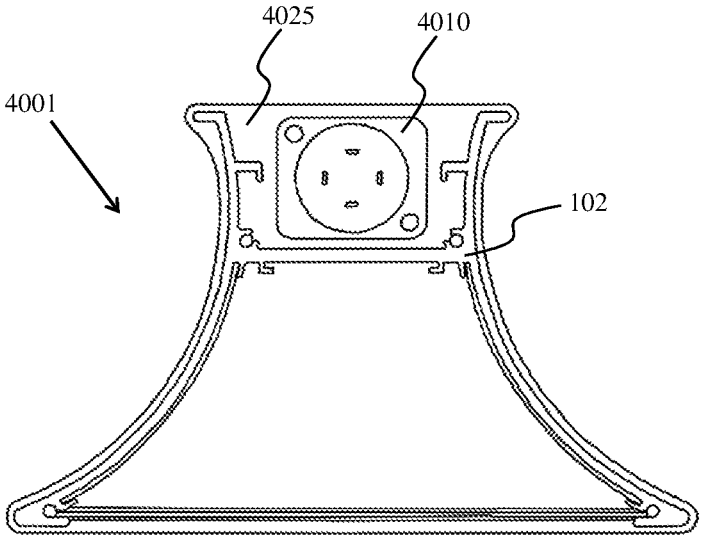
FIG. 33 illustrates a cut view of a luminaire having an IMS chassis connector on the endcap in accordance with aspects of the embodiments.
Figure 34:
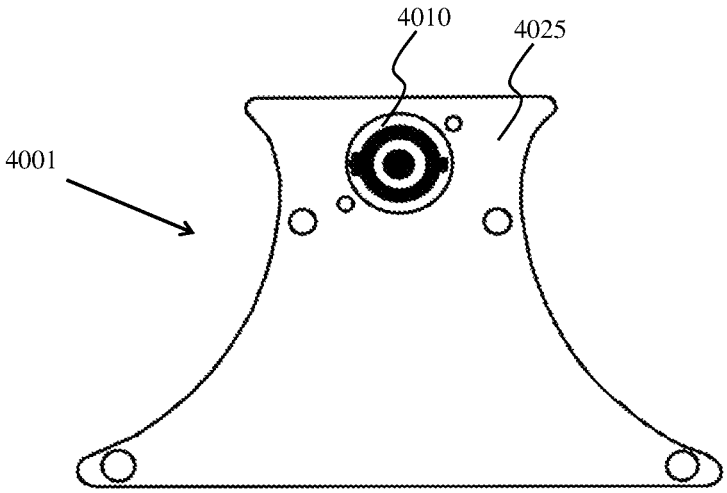
FIG. 34 illustrates a view from the end of a luminaire having an IMS chassis connector on the endcap in accordance with aspects of the embodiments.

FIGS. 33 and 34 illustrate a luminaire 4001 having an IMS chassis connector 4010 on the endcap 4025 in accordance with aspects of the embodiments. FIG. 33 is a cut view viewing the endcap from inside the luminaire. FIG. 34 is an end view of that same luminaire's endcap.

FIG. 34 illustrates an IMS chassis connector 4010 attached to the endcap. Alternatively, the IMS cable can pass through a hole in the endcap and into the wireway to be electrically connected to the luminaire's internal circuitry. The connection to the internal circuitry can be to a chassis connector, a terminal block, direct soldering, crimping, or clamping. As such, a chassis connector, a terminal block, or other connector can be can be fixedly attached to an internal structural element or internal printed circuit board. The cables wires can be electrically connected to such a chassis connector, terminal block, or other connector. The cable's wires can be directly soldered to the internal printed circuit board, can be clamped to it, or can be attached to a terminal block mounted on the printed circuit board. A voltage booster and an LED driver with DALI can be attached to the printed circuit board. The printed circuit board, or another printed circuit board, can be a component of the LED array circuit. Those practiced in electronics are aware of the terminal blocks, solder pads, and other devices that are used for electrically connecting wires to circuit boards.

Figure 35:
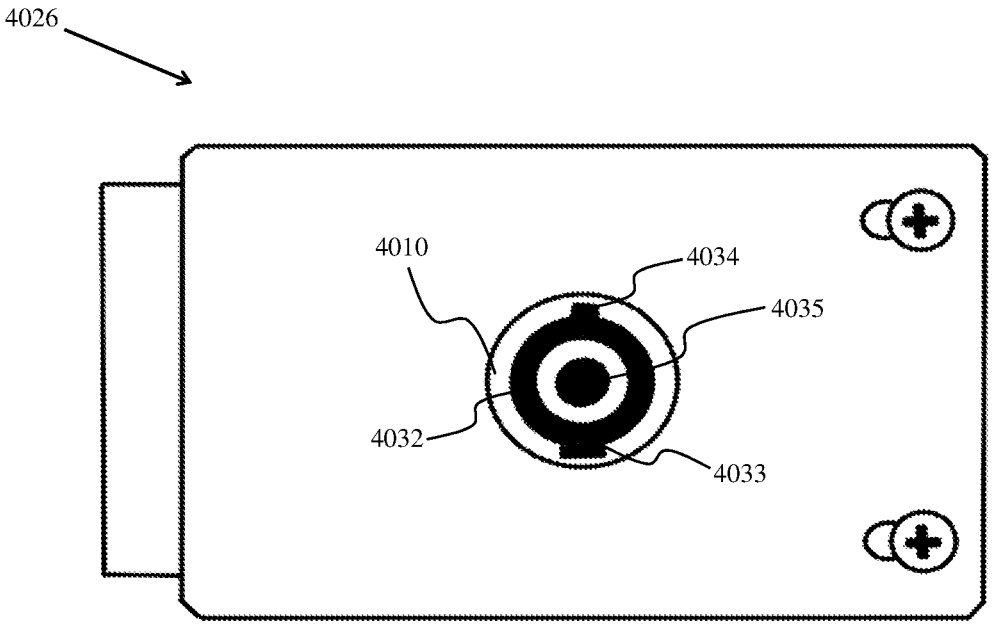
FIG. 35 illustrates a view of a wireway cover having an IMS chassis connector in accordance with aspects of the embodiments.
Figure 36:
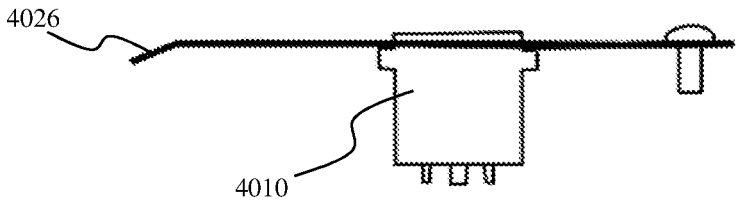
FIG. 36 illustrates a side view of a wireway cover having an IMS chassis connector in accordance with aspects of the embodiments.

FIGS. 35 and 36 illustrate a wireway cover 4026 having an IMS chassis connector 4010 in accordance with aspects of the embodiments. FIG. 35 shows the wireway cover 4026 and the IMS chassis connector 4010 from above. FIG. 36 shows the wireway cover 4026 and IMS chassis connector 4010 from the side.

Figure 37:
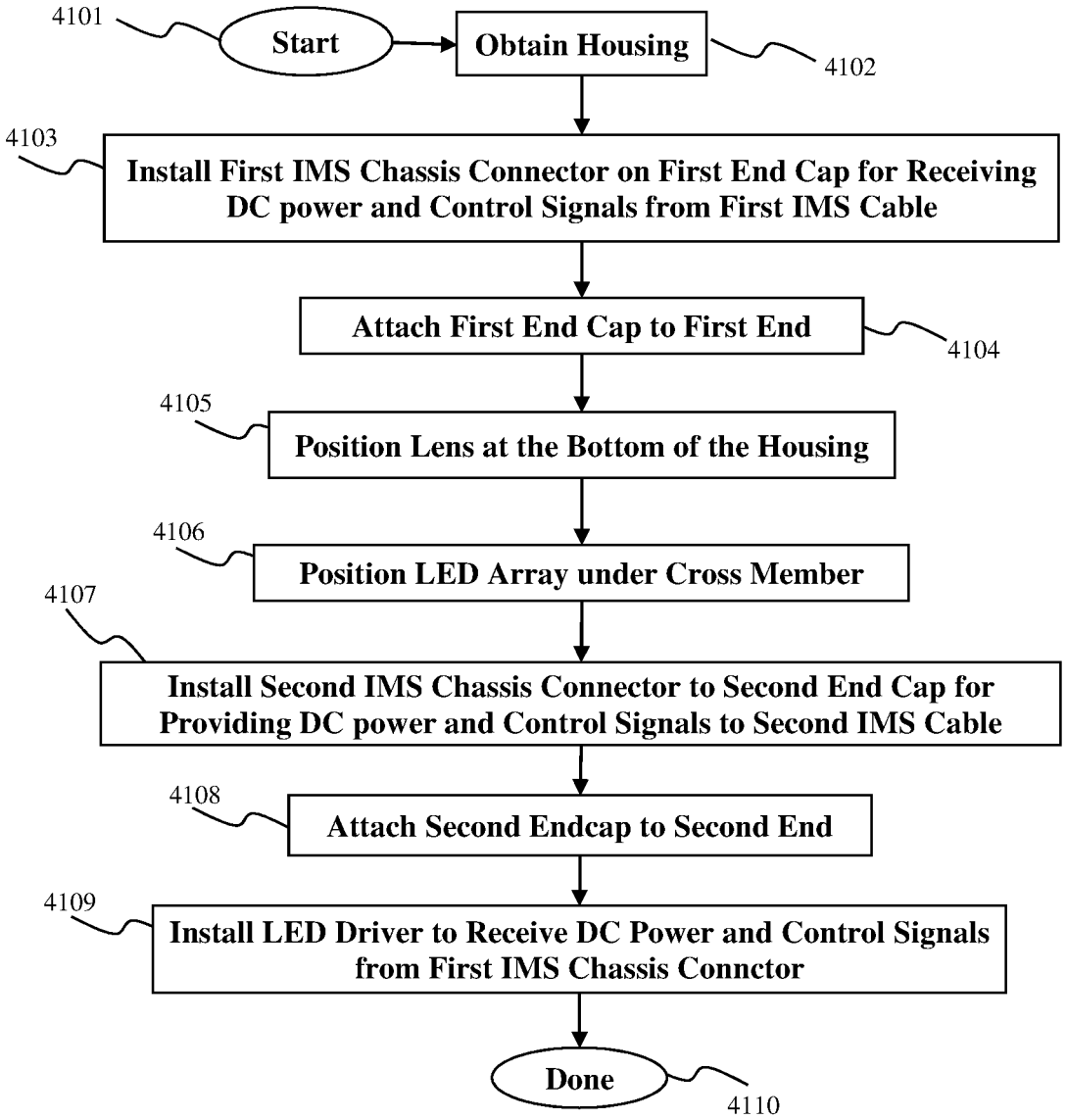
FIG. 37 illustrates a high-level flow diagram of a method for providing a luminaire in accordance with aspects of the embodiments.

FIG. 37 illustrates a high-level flow diagram of a method for providing a luminaire in accordance with aspects of the embodiments. After the start 4101, a housing is obtained 4102. A first IMS chassis connector is installed on a first endcap such that the luminair can receive DC power and control signals from a first IMS cable 4103. The first endcap is attached to the first end 4104. The lens is positioned at the bottom of the housing 4105. The LED array is positioned under the cross member 4106 such that light from the LEDs can shine through the lens. A second IMS chassis connector is installed on the second endcap. 4107. As such, the luminaire can provide the DC power and control signals to a second IMS cable. The second endcap is attached to the luminaire 4108. The LED driver is installed 4109. The LED driver can be controlled by the control signals and can power the LED array using the DC power. Finally, the method is done 4110.

Figure 38:
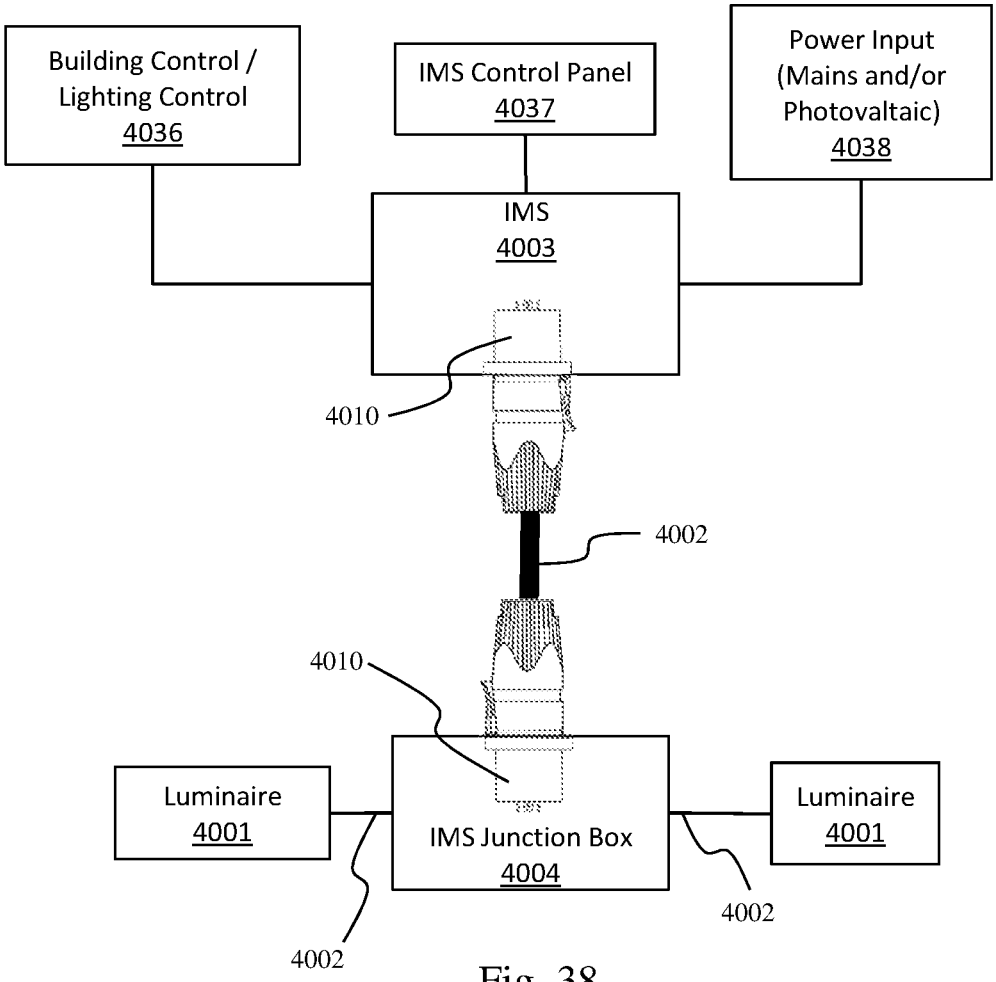
FIG. 38 illustrates an IMS powering luminaires via an IMS junction box in accordance with aspects of the embodiments.

FIG. 38 illustrates an IMS 4003 powering luminaires 4001 via an IMS junction box 4004 in accordance with aspects of the embodiments. The IMS 4003 can receive power directly from the building mains or a photovoltaic system 4038. Here, building mains power is the AC power that is provided to and distributed through a building (e.g. 120 VAC, 240 VAC, etc.). An IMS control panel 4037 is a graphical user interface (GUI) or device connected to the IMS 4003 that provides for controlling and managing the IMS 4003. For example, the IMS control panel 4037 can be a device presenting an IMS management GUI. For security, it is best practice that an IMS control panel 4037 that is permissioned to manage the IMS 4038 is directly connected by a wired communications channel such as ethernet or that the local network uses firewall rules restricting the devices that can access the IMS's management interface (e.g. a set of internet protocol (IP) ports accessible over a computer network) or the IMS in general. Here, the IMS may have a management interface GUI and a control interface GUI. The control interface GUI provides for controlling the luminaires. The management interface GUI provides for controlling the luminaires, for controlling the IMS (shutdown, restart, update software, etc.) and for configuring the lighting controlled by the IMS (creating groups of luminaires, associating luminaire addresses with location names, discovering device connected via DALI, etc.). Many buildings have building control and lighting control systems 4036 through which personnel can control or monitor heating, cooling, elevators, locks, access control, lights, light switches, etc. The IMS can provide access such as designated IP ports such that a building's building control system has access to turn lights on/off, read sensors (e.g. DALI enabled light switches or motion detectors), and otherwise monitor and control IMS powered devices. An IMS cable 4002 can connect the IMS chassis connectors 4010 of a junction box 4004 and an IMS 4003. The AC powered IMSs include 1500 Watt IMSs and 3000 Watt IMSs. These power levels and the 54 VDC IMS output are consistent with certain safety requirements, voltage drop in the IMS cables, and other factors revealed in testing.

Figure 39:
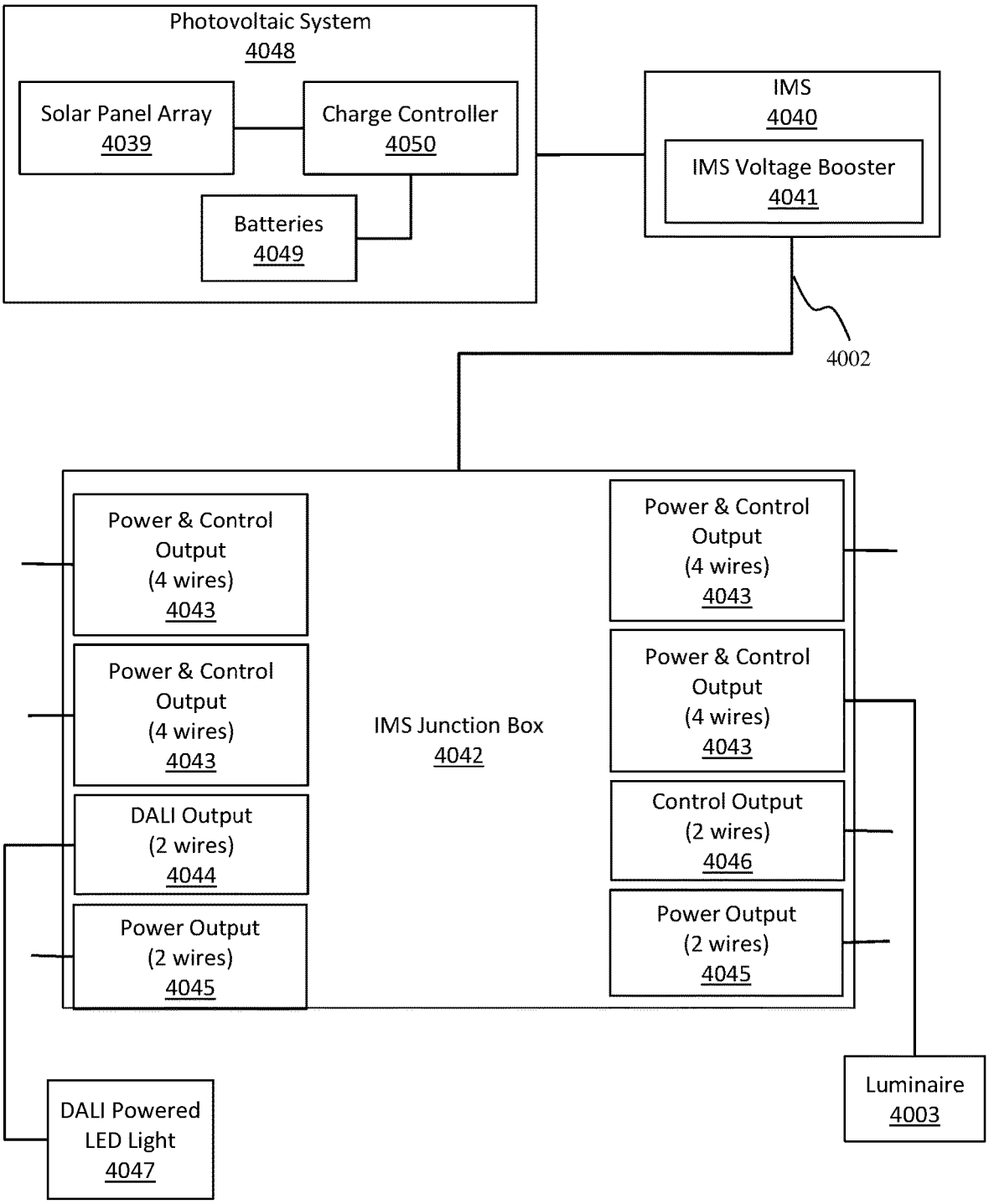
FIG. 39 illustrates a solar powered IMS based lighting system in accordance with aspects of the embodiments.

FIG. 39 illustrates a solar powered IMS based lighting system in accordance with aspects of the embodiments. A photovoltaic system 4048 can have one or more solar panels 4039, a charge controller 4050, and batteries 4049. Many photovoltaic systems do not have batteries. An inverter, sometimes integral to the charge converter, can provide AC power to the building mains. The solar panel array 4039 produces DC power. The charge controller 4050 can adjust the voltage level of the solar panels to thereby maximize the solar panel's output power. The charge controller can also provide DC power at a specified voltage. Currently, 24 VDC and 48 VDC photovoltaic systems are popular because those voltages are compatible with series connected 12 V batteries.

It is advantageous to power the IMS 4040 directly from the photovoltaic system 4048 because a single DC to DC power conversion is more efficient than converting DC to building mains (e.g. 120 VAC) and then powering the IMS from building mains. Batteries 4049 can supplement the photovoltaic system's DC power output when needed and without DC power conversion. The illustrated IMS 4040 therefore has an IMS voltage booster 4041 that accepts DC power from the photovoltaic system 4048 and produces DC power at a higher voltage. Through testing and prototyping, it has been found that the IMS should produce 54 VDC (plus/minus 1 volt). The DC powered IMSs include 1500 Watt IMSs and 3000 Watt IMSs.

The IMS junction box 4042 of FIG. 39 is compatible with both AC and DC powered IMSs and is connected to the IMS 4004 by an IMS cable 4002. The IMS junction box 4042 can have numerous power and control outputs 4043, such as IMS chassis connectors, configured for the four-wire power and control signal connections. The IMS junction box 4042 can also provide power outputs 4045 and control outputs 4046, 4044. The power outputs 4045 carry DC power using two wires (a power line and a return line) without also carrying control signals. The control outputs 4044, 4046 provide control signals using two wires. A control output 4046 can provide control signals without providing DC power. Another control output 4044, such as a DALI output, can provide both control signals and DC power over 2 wires. For example, DALI outputs have DALI+ and DALI− lines providing power and control. DALI is capable of providing DC power, although far less DC power than the four-wire IMS connections of the IMS 4040, IMS junction box 4042, and luminaires 4003. As such, a two-wire DALI output 4044 from the IMS junction box 4042 can power and can control a DALI powered LED light 4047.

As seen in FIG. 32, the IMS junction box can include a voltage booster 4011. Voltage can drop along a cable such as an IMS cable. An IMS can output 54 VDC to an IMS junction box that receives 45 VDC due to cable loss. The IMS junction box can boost the voltage. An IMS junction box receiving 45 VDC can provide 1000 Watts at 54 VDC without requiring active cooling.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A luminaire comprising:

a housing comprising a top, a bottom, and an extrusion profile, wherein the extrusion profile comprises a height and a width, wherein the housing comprises a first end and a second end distanced from the first end by a length, wherein the housing comprises a plurality of length running elements, the plurality of length running elements comprising a cross member, and two sides, the cross member connecting the two sides to create a wireway above the cross member and a lower cavity below the cross member;

a first endcap attached to the first end;

a second endcap attached to the second end;

a lens positioned at the bottom and enclosing the lower cavity;

an LED array comprising a circuit board and a plurality of LEDs wherein the LED array is positioned under the cross member and light from the LEDs passes through the lens;

an IMS chassis connector though which DC power passes via at least two conductors and through which control signals pass via two different conductors; and an LED driver powering the LED array, the LED driver receiving the DC power and the control signals from the IMS chassis connector.

2. The luminaire of claim 1 wherein the extrusion profile is symmetric about a center line parallel to the height.

3. The luminaire of claim 1 further comprising:

a housing cover covering the wireway; and a wireway cover covering a wireway opening in the housing cover.

4. The luminaire of claim 3 wherein the IMS chassis connector is installed on the wireway cover and configured for an IMS cable to provide the DC power and the control signals to the luminaire.

5. The luminaire of claim 1 wherein the IMS chassis connector is installed on the first endcap and configured for an IMS cable to provide the DC power and the control signals to the luminaire.

6. The luminaire of claim 1 further comprising a second IMS chassis connector configured to pass the DC power and the control signals into and out of the luminaire.

7. The luminaire of claim 6 further comprising:

a housing cover covering the wireway; and a wireway cover covering a wireway opening in the housing cover wherein the second IMS chassis connector is installed on the wireway cover.

8. The luminaire of claim 6 wherein the second IMS chassis connector is installed on the second endcap.

9. A luminaire comprising:

a housing comprising a top, a bottom, and an extrusion profile, wherein the extrusion profile comprises a height and a width, wherein the housing comprises a first end and a second end distanced from the first end by a length, wherein the housing comprises a plurality of length running elements, the plurality of length running elements comprising a cross member, and two sides, the cross member connecting the two sides to create a wireway above the cross member and a lower cavity below the cross member;

a first endcap attached to the first end;

a second endcap attached to the second end;

a lens positioned at the bottom and enclosing the lower cavity;

an LED array comprising a circuit board and a plurality of LEDs wherein the LED array is positioned under the cross member and light from the plurality of LEDs passes through the lens;

a first IMS chassis connector though which DC power passes via two conductors and through which control signals pass via two different conductors;

a second IMS chassis connector electrically connected to the first IMS chassis connector;

a voltage booster receiving the DC power and producing boosted DC power; and an LED driver powering the LED array, the LED driver receiving the control signals from the first IMS chassis connector or the second IMS chassis connector.

10. The luminaire of claim 9 wherein the second IMS chassis connector is configured to provide to the control signals and the boosted DC power to an IMS cable.

11. The luminaire of claim 9 wherein the LED driver receives the DC power.

12. The luminaire of claim 9 wherein the LED driver receives the boosted DC power.

13. A method comprising:

obtaining a housing comprising a top, a bottom, and an extrusion profile, wherein the extrusion profile comprises a height and a width, wherein the housing comprises a first end and a second end distanced from the first end by a length, wherein the housing comprises a plurality of length running elements, the plurality of length running elements comprising a cross member, and two sides, the cross member connecting the two sides to create a wireway above the cross member and a lower cavity below the cross member;

attaching a first endcap to the first end;

attaching a second endcap to the second end;

positioning a lens at the bottom to enclose the lower cavity;

positioning an LED array under the cross member, the LED array comprising a circuit board and a plurality of LEDs wherein the LED array is configured for light from the plurality of LEDs to pass through the lens;

installing an IMS chassis connector configured to receive DC power and control signals from an IMS cable, the IMS cable providing the DC power via two conductors and providing the control signals via two different conductors; and installing an LED driver powering the LED array, the LED driver configured to receive the DC power and the control signals from the IMS chassis connector.

14. The method of claim 13 further comprising:

covering the wireway with a housing cover, the housing cover comprising a wireway opening; and covering the wireway opening with a wireway cover wherein the IMS chassis connector is installed on the wireway cover.

15. The method of claim 13 wherein the IMS chassis connector is installed on the first endcap.

16. The method of claim 13 further comprising installing a second IMS chassis connector that is configured to pass the DC power and the control signals to a second IMS cable.

17. The method of claim 16 wherein the second IMS chassis connector is installed on the second endcap.

18. The method of claim 16 further comprising:

covering the wireway with a housing cover, the housing cover comprising a wireway opening; and covering the wireway opening with a wireway cover wherein the second IMS chassis connector is installed on the wireway cover.

19. The method of claim 13 further comprising:

installing a voltage booster configured to receive the DC power and to produce boosted DC power; and installing a second IMS chassis connector that is configured to pass the boosted DC power and the control signals to a second IMS cable.

20. The method of claim 19 wherein the second IMS chassis connector is installed on the second endcap.

* * * * *